US010507653B2

(12) United States Patent
Tamura

(10) Patent No.: US 10,507,653 B2
(45) Date of Patent: Dec. 17, 2019

(54) LARGE FORMAT PRINTER

(71) Applicant: SEIKO EPSON CORPORATION, Tokyo (JP)

(72) Inventor: Noboru Tamura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/012,924

(22) Filed: Jun. 20, 2018

(65) Prior Publication Data

US 2018/0370228 A1 Dec. 27, 2018

(30) Foreign Application Priority Data

Jun. 22, 2017 (JP) ..... 2017-122325

(51) Int. Cl.
*B41J 2/045* (2006.01)
*B41J 3/30* (2006.01)

(52) U.S. Cl.
CPC ..... *B41J 2/04588* (2013.01); *B41J 2/0458* (2013.01); *B41J 2/04541* (2013.01); *B41J 2/04581* (2013.01); *B41J 3/30* (2013.01)

(58) Field of Classification Search
CPC ..... B41J 2/04588; B41J 2/04581; B41J 2/04541; B41J 2/0458; B41J 11/001; B41J 3/30
See application file for complete search history.

(56) References Cited

U.S. PATENT DOCUMENTS 5,492,424 A * 2/1996 Hori ..... B41J 19/202 361/749
6,860,589 B2 3/2005 Tamura
7,084,996 B2 8/2006 Kubo
9,016,833 B2 4/2015 Ito et al.
2002/0054311 A1* 5/2002 Kubo ..... B41J 2/04581 358/1.13
2014/0192114 A1* 7/2014 Ito ..... B41J 19/005 347/37
2018/0272700 A1* 9/2018 Ito ..... B41J 2/04508

FOREIGN PATENT DOCUMENTS

JP 2002-019106 A 1/2002
JP 2003-226006 A 8/2003
JP 2014-133358 A 7/2014

* cited by examiner

*Primary Examiner* — Sharon A. Polk
(74) *Attorney, Agent, or Firm* — Global IP Counselors, LLP

(57) ABSTRACT

In a large format printer, a print head which includes a plurality of drive elements is provided with a head drive circuit which applies a voltage which is based on a first drive signal, a second drive signal, and a reference voltage signal which are input from a control circuit via a cable to the drive element. In a first flat cable and a second flat cable which configure the cable and which are in an overlapping state, a first wire which propagates a first drive signal is adjacent to a third wire which propagates a reference voltage signal, a second wire which propagates a second drive signal is adjacent to a third wire, and, in an overlapping direction, the first wire faces the third wire and the second wire faces the third wire.

9 Claims, 10 Drawing Sheets

RD

| (SIH, SIL) | T1 | | T2 | |
|---|---|---|---|---|
| | Sa | Sb | Sa | Sb |
| (1, 1) [LARGE DOT] | H | L | H | L |
| (1, 0) [MEDIUM DOT] | H | L | L | H |
| (0, 1) [SMALL DOT] | L | L | L | H |
| (0, 0) [NON-RECORDING] | L | H | L | L |

| | L1 | L2 | L3 | L4 | L5 | L6 |
|---|---|---|---|---|---|---|
| L1 | + | 1.00 | 0.50 | 0.33 | 0.25 | 0.20 |
| L2 | -1.00 | – | -1.00 | -0.50 | -0.33 | -0.25 |
| L3 | 0.50 | 1.00 | + | 1.00 | 0.50 | 0.33 |
| L4 | -0.33 | -0.50 | -1.00 | – | -1.00 | -0.50 |
| L5 | 0.25 | 0.33 | 0.50 | 1.00 | + | 1.00 |
| L6 | -0.20 | -0.25 | -0.33 | -0.50 | -1.00 | – |
| TOTAL | -0.78 | 1.58 | -1.33 | 1.33 | -1.58 | 0.78 |

FIG. 13

48

| 481 | 482 |
|---|---|
| COMA1 | VBS1 |
| VBS1 | COMB1 |
| COMA1 | VBS1 |
| VBS1 | COMB1 |
| COMA2 | VBS2 |
| VBS2 | COMB2 |
| COMA2 | VBS2 |
| VBS2 | COMB2 |
| COMA3 | VBS3 |
| VBS3 | COMB3 |
| COMA3 | VBS3 |
| VBS3 | COMB3 |
| COMA4 | VBS4 |
| VBS4 | COMB4 |
| COMA4 | VBS4 |
| VBS4 | COMB4 |

WA

WA

FIG. 14

48

| 481 | 482 |
|---|---|
| COMA1 | VBS1 |
| VBS1 | COMA1 |
| COMB1 | VBS1 |
| VBS1 | COMB1 |
| COMA2 | VBS2 |
| VBS2 | COMA2 |
| COMB2 | VBS2 |
| VBS2 | COMB2 |
| COMA3 | VBS3 |
| VBS3 | COMA3 |
| COMB3 | VBS3 |
| VBS3 | COMB3 |
| COMA4 | VBS4 |
| VBS4 | COMA4 |
| COMB4 | VBS4 |
| VBS4 | COMB4 |

WA

WA

LARGE FORMAT PRINTER

This application claims priority to Japanese Patent Application No. 2017-122325 filed on Jun. 22, 2017. The entire disclosure of Japanese Patent Application No. 2017-122325 is hereby incorporated herein by reference.

BACKGROUND

1. Technical Field

The present invention relates to a large format printer which performs serial printing on a medium of a large format size (for example, a size greater than or equal to A3 short side width) in which a print head moves reciprocally in a scanning direction.

2. Related Art

JP-A-2014-133358 discloses an ink jet type printer in which a control signal and a drive signal are supplied from a control substrate which is attached to a housing of a printing apparatus to a print head via a flexible cable (an example of a cable) and the print head which moves reciprocally discharges droplets based on the drive signal to perform serial printing. JP-A-2002-19106 discloses a printing apparatus in which a carriage, on which is installed a print head and a drive circuit (a carriage substrate) which generates a drive pulse and applies the drive pulse to the print head, moves reciprocally, where the printing apparatus performs printing of an image by discharging droplets from the print head. In the printing apparatus, the drive circuit of the print head side is connected to the control circuit (the control substrate) of the main body side via a flexible cable and drives the print head based on the drive signal which is received from the control circuit via the flexible cable.

Incidentally, in a large format printer (LFP) which performs serial printing on a medium of a large size (for example, of a size greater than or equal to A3 short side width), a movement distance of the print head increases according to an anticipated maximum width of the medium and the cable which connects the print head to the control substrate (the control circuit) may be greater than or equal to 1 m.

For example, in JP-A-2003-226006, a cable is configured by overlaying and disposing two flexible flat cables, and a plurality of wires (core wires) on which drive signals COMA to COMD having the same waveform and ground signals AGNDA and AGNDD (an example of a reference voltage signal) are propagated are arranged in the two flat cables. In each of the two flat cables, the wires for the drive signals on which the drive signals are propagated are adjacent to the wires for ground on which the ground signals are propagated, and the wires for the drive signals face the wires for ground in the overlapping direction of the cables.

A printer which is configured to drive a print head using, as drive signals, two types of drive signal, a first drive signal including a first waveform and a second drive signal including a second waveform which is different from the first waveform, is known.

However, the longer the cable in the large format printer, the greater the inductance and impedance of the wires. Therefore, mutual induction occurs between the drive signals which are propagated on the wires originating from the inductance which floats on the long wires inside the cable. Therefore, in a case in which the printing apparatuses which are disclosed in JP-A-2014-133358 and JP-A-2002-19106 are applied to a large format printer, comparatively large overshooting which originates in the mutual induction or the like of the drive signals occurs easily in the process of supplying the drive signals from the control circuit to the print head via the long cable. In a case in which the first drive signal and the second drive signal which have different waveforms from each other are used as the drive signals, JP-A-2014-133358, JP-A-2002-19106, and JP-A-2003-226006 do not disclose or imply a cable wiring structure in which a reduction effect may be obtained for overshooting which originates in the mutual induction between the same types of drive signals (between the first drive signals or between the second drive signals) which are propagated on the wired inside the first cables and the second cables.

As a result, there is a concern that, depending on the overshooting of the drive signal, an overvoltage which exceeds a withstand voltage (a rated voltage) is momentarily applied to circuits or drive elements which are installed in the print head and the print head is damaged. When the drive signal in which the overshooting occurs is applied to the print head, erroneous operations such as decreases in printing precision and printing stability or erroneous discharging of droplets occur more easily and disruption to print quality may occur. This type of problem is not limited to printers of the large format printer discharging type (the ink jet type) in which a liquid is discharged, and is generally common to large format printers which print using other recording types such as a dot impact type or a heat transfer type.

SUMMARY

An advantage of some aspects of the invention is to provide a large format printer which reduces overshooting which originates in mutual induction between drive signals in a configuration in which a plurality of types of drive signal having different waveforms are propagated on a cable, and which is capable of reducing at least one problem such as damage to the print head and disruption to print quality.

Hereinafter, means of the invention and operation effects thereof will be described.

According to an aspect of the invention, there is provided a large format printer capable of serial printing on a medium which is greater than or equal to A3 short side width, the large format printer including a control circuit which is provided with a drive signal generating circuit which outputs a first drive signal including a first waveform, a second drive signal including a second waveform, and a reference voltage signal, a print head which includes a plurality of drive elements which perform printing according to applied voltages, and a cable which connects the control circuit to the print head, in which the print head includes a head drive circuit which applies voltages corresponding to waveforms which are selected from the first waveform in the first drive signal and the second waveform in the second drive signal which are input via the cable, to the drive elements, in which the cable includes, in an overlapping state, a first cable and a second cable which each include a first wire which propagates the first drive signal, a second wire which propagates the second drive signal, and a third wire which propagates the reference voltage signal, and in which in the first cable and the second cable, the first wire is adjacent to the third wire, the second wire is adjacent to the third wire, and, in an overlapping direction, the first wire faces the third wire, and the second wire faces the third wire.

In this configuration, in the first cable and the second cable, the first wire is adjacent to the third wire, the second wire is adjacent to the third wire, and, in the overlapping direction between the first cable and the second cable, the first wire faces the third wire, and the second wire faces the third wire. Accordingly, in a configuration in which a plurality of types of drive signal having different waveforms are propagates via the cable, it is possible to effectively reduce the overshooting originating in the mutual induction between the drive signals.

In the large format printer, it is preferable that the first wire of the first cable and the first wire of the second cable be electrically connected to each other in the print head, or the second wire of the first cable and the second wire of the second cable be electrically connected to each other in the print head.

In this configuration, it is possible to average and moderate the degree of influence of the magnetic field caused by the mutual induction between the drive signals in the first cable and the degree of influence of the magnetic field caused by the mutual induction between the drive signals in the second cable. Accordingly, it is possible to more effectively reduce the overshooting originating in the mutual induction of the drive signals.

In the large format printer, it is preferable that the print head include one or a plurality of drive element groups each including a plurality of drive elements which are driven to print a same type of color, that the first cable and the second cable include a plurality of the first wires which propagate the first drive signals and a plurality of the second wires which propagate the second drive signals, to each of the drive element groups which prints the same type of color, and that, of the plurality of first wires in the first cable, the first wire which is positioned at an endmost portion in a wire arrangement direction and, of the plurality of first wires in the second cable, the first wire which is positioned next to the third wire which is positioned at an endmost portion in the wire arrangement direction be electrically connected to each other in the print head, or, of the plurality of second wires in the first cable, the second wire which is positioned next to the third wire which is positioned at an endmost portion in the wire arrangement direction and, of the plurality of second wires in the second cable, the second wire which is positioned at an endmost portion in the wire arrangement direction be electrically connected to each other in the print head.

In this configuration, the maximum value of the degree of influence of the magnetic field caused by the mutual induction between the drive signals in one of the first cable and the second cable and the minimum value of the degree of influence of the magnetic field caused by the mutual induction between the drive signals in the other of the first cable and the second cable are averaged by conducting the two first wires. Alternatively, the maximum value of the degree of influence of the magnetic field caused by the mutual induction between the drive signals in one of the first cable and the second cable and the minimum value of the degree of influence of the magnetic field caused by the mutual induction between the drive signals in the other of the first cable and the second cable are averaged by conducting the two second wires. Accordingly, it is possible to effectively reduce the overshooting originating in the mutual induction of the drive signals.

It is preferable that the large format printer further include a plurality of drive element groups which print different colors, in which Q (where Q is a natural number greater than or equal to 2) of the drive element groups which print a same type of color may be provided, in which Q of the first wires which propagate the first drive signals which are supplied to Q of the drive element groups, respectively, be electrically connected to each other in the print head, and in which Q of the second wires which propagate the second drive signals which are supplied to Q of the drive element groups, respectively, be electrically connected to each other in the print head.

In this configuration, the maximum value and the minimum value of the degrees of influence of the magnetic fields caused by the mutual induction is averaged between Q of the first wires and the maximum value and the minimum value of the degrees of influence of the magnetic fields caused by the mutual induction is averaged between Q of the second wires, respectively. Accordingly, it is possible to effectively reduce the overshooting which occurs in the first drive signals and the second drive signals.

In the large format printer, it is preferable that a maximum width over which the serial printing is possible be 24 inches to 75 inches.

In this configuration, even if the cable is long to the extent that the serial printing is possible at the maximum width of 24 inches to 75 inches, it is possible to effectively suppress the occurrence of the overshooting in the drive signal in the process of the drive signal being propagated on the cable.

In the large format printer, it is preferable that the maximum width over which the serial printing is possible be any one of 24 inches, 36 inches, 44 inches, and 64 inches.

In this configuration, even if the cable is a comparatively long cable which supports the serial printing of 24 inches, 36 inches, 44 inches, and 64 inches, it is possible to effectively suppress the occurrence of the overshooting in the drive signal in the process of the drive signal being propagated on the cable.

In the large format printer, it is preferable that the print head discharge a liquid at a frequency greater than or equal to 30 kHz to perform printing.

In this configuration, even if the large format printer is configured such that the print head discharges a liquid at a frequency greater than or equal to 30 kHz, the drive signal which is propagated on the flexible cable has a high frequency, and the overshooting occurs easily in the process of propagation, it is possible to effectively suppress the overshooting which occurs.

BRIEF DESCRIPTION OF THE DRAWINGS

The invention will be described with reference to the accompanying drawings, wherein like numbers reference like elements.

FIG. 13 is a schematic diagram illustrating the sequences of the drive signals and reference voltage signals which are propagated on a first flat cable and a second flat cable in a comparative example.

FIG. 14 is a schematic diagram illustrating the sequences of the drive signals and the reference voltage signals which are propagated on a first flat cable and a second flat cable in an example.

DESCRIPTION OF EXEMPLARY EMBODIMENTS

Figure 1:
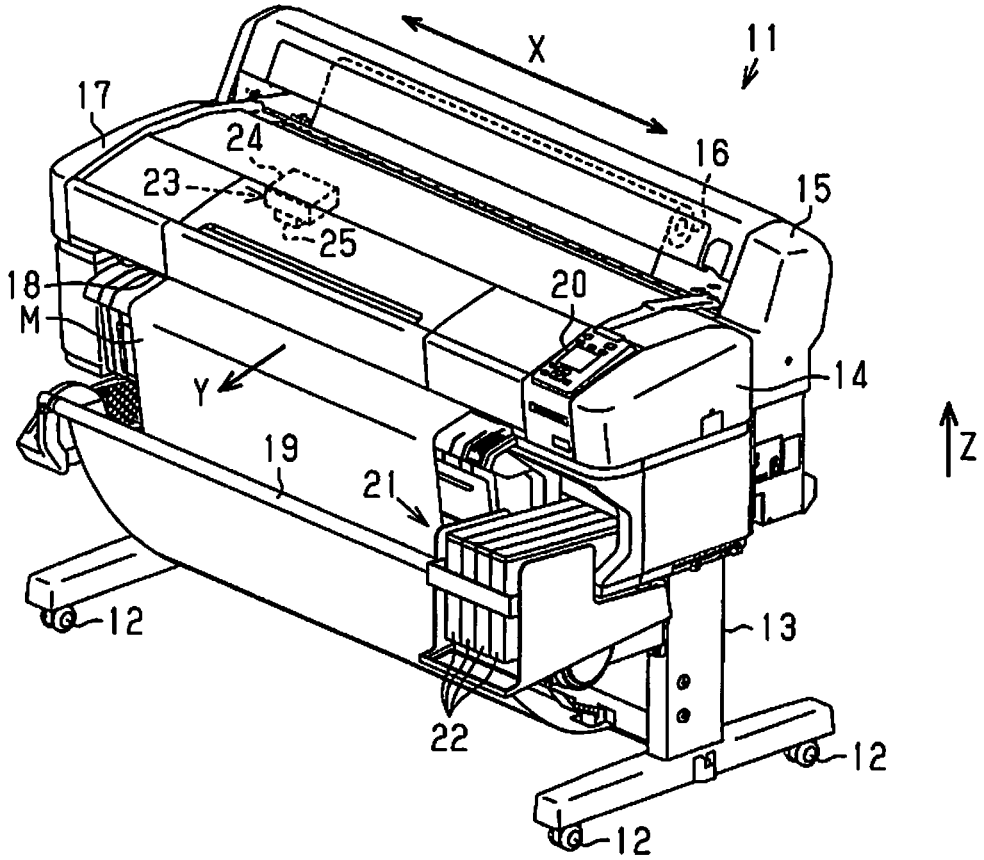
FIG. 1 is a schematic perspective diagram of a large format printer in an embodiment.

Hereinafter, an embodiment that embodies the large format printer will be described with reference to the drawings. As illustrated in FIG. 1, a large format printer 11 of the present embodiment is a serial type (a serial printing type) of printer. The large format printer 11 is an ink jet printer which forms a dot group on a medium M (a printing medium) such as a paper or a film by discharging droplets (for example, an ink) according to image data which is supplied from an external host computer, for example, and thus prints an image (including characters, pictures, and the like). In the present embodiment, in the large format printer 11, a movement direction of a carriage 24 (described later) is described as a main scanning direction X, a transport direction of the medium M is described as a sub-scanning direction Y, and a vertical direction (vertically upward facing (a height direction) in the example of FIG. 1) is described as Z. The main scanning direction X, the sub-scanning direction Y, and the vertical direction Z are denoted in the drawings as three orthogonally intersecting axes. However, the dispositional relationship of the configurations is not limited to being orthogonally intersecting.

In the present embodiment, the large format printer is a printer capable of performing serial printing on the medium M which is greater than or equal to A3 short side width (297 mm). Therefore, in the large format printer 11, a head unit 23 which is illustrated in FIG. 1 is capable of moving reciprocally in the main scanning direction X across a movement range in which serial printing is possible at a printing width greater than or equal to A3 short side width.

First, a description will be given of the schematic configuration of the large format printer 11 with reference to FIG. 1. As illustrated in FIG. 1, the large format printer 11 includes a support stand 13 and a substantially rectangular parallelepiped apparatus main body 14 (hereinafter also referred to simply as "the main body 14"). Wheels 12 are attached to the bottom ends of the support stand 13 and the apparatus main body 14 is supported by the support stand 13. A roll body 16 (for example, rolled paper or the like) in which the medium M such as long paper or film is wound in multiple layers in a cylindrical shape is loaded into the inside of a feed unit 15 which protrudes upward at the rear portion of the main body 14. The medium M which is fed out from the feed unit 15 is introduced into the inside of a housing 17 of the main body 14 and is transported by a transport device (a transport unit) (not illustrated) which is provided inside the housing 17. An image is printed onto the medium M due to the head unit 23 discharging droplets (for example, ink droplets) onto the medium M which is transported by the transport device. The medium M after printing is output from an output port 18 which is open on the front surface side of the housing 17 and is received by a medium receiving unit 19 which is attached under the output port 18.

An operation panel 20 for the user to perform setting operations and input operations of the large format printer 11 is attached to a top surface end portion of the main body 14. A liquid storage unit 21 is provided on one end bottom portion of the main body 14. A plurality of (in the example of FIG. 1, four) liquid storage portions 22 (for example, ink cartridges or ink tanks), which store inks which serve as examples of the liquid, are attached to the liquid storage unit 21 in a state of being attachable and detachable. Each of the plurality of liquid storage portion 22 stores a different type (for example, color) of the liquid (for example, ink). In an example in which the liquids are inks, a plurality of greater than or equal to four of the liquid storage portions 22 are provided in which one of each of a plurality of colors of ink are stored. The colors of the ink include, for example, black (K), cyan (C), magenta (M), and yellow (Y). In the example of FIG. 1, the four liquid storage portions 22 corresponding to the four colors are illustrated. However, for example, greater than or equal to five of the liquid storage portions 22 including at least one liquid storage portion 22 corresponding to another color such as gray, green, violet, or the like may be provided.

The head unit 23 which discharges droplets (ink droplets) onto the medium M and performs printing on the medium M is provided inside the housing 17. The head unit 23 includes the carriage 24 and a print head 25 which is installed on the carriage 24 to face the medium M. The carriage 24 is stored in a state of being capable of moving reciprocally in the main scanning direction X inside the main body 14. The colored liquids (inks) are supplied from the liquid storage portions 22 to the head unit 23 through tubes (not illustrated). The large format printer 11 is not limited to an off-carriage type configuration in which the liquid storage unit 21 is attached to the main body 14, and may have an on-carriage type configuration in which the plurality of liquid storage portions 22 are attached to the carriage 24.

Figure 2:
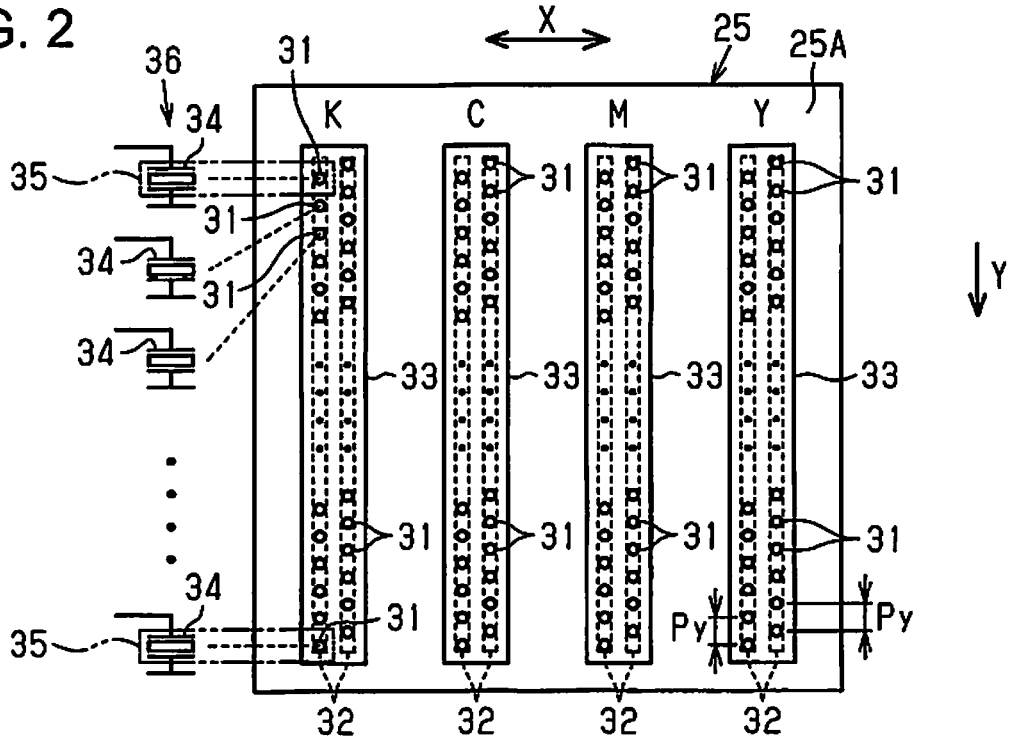
FIG. 2 is a schematic diagram illustrating a discharge surface and drive elements of a print head.

Next, a description will be given of the print head 25 with reference to FIG. 2. FIG. 2 illustrates a discharge surface 25A (a nozzle opening surface), in which multiple nozzles 31 capable of discharging droplets are opened, in the print head 25. As illustrated in FIG. 2, four nozzle plates 33 are provided to line up along the main scanning direction X on the discharge surface 25A of, the print head 25. Each of the nozzle plates 33 includes two (two rows of) nozzle rows 32. Multiple nozzles 31 are lined up at a predetermined pitch Py (a nozzle pitch) along the sub-scanning direction Y in each of the nozzle rows 32. A number F of the nozzles 31 per single nozzle row is a value (for example, 400) within a range of 100 to 600, for example. In the two nozzle rows 32 which are provided in each of the nozzle plates 33, the relationship between the nozzles 31 is shifted by half of the pitch Py in the sub-scanning direction Y alternately. In the present embodiment, eight of the nozzle rows 32 are provided on the discharge surface 25A. In the example illustrated in FIG. 2, the two nozzle rows 32 that are provided in the same nozzle plate 33 discharge the same color of ink and printing by discharging of the four colors of black (K), cyan (C), magenta (M), and yellow (Y) is possible at a high resolution corresponding to ½ the distance of the nozzle pitch Py in the sub-scanning direction Y. Greater than or equal to five (for example, six or eight) of the nozzle plates 33 may be provided on the print head 25. A configuration may also be adopted in which only a single row of the nozzle rows 32 is provided on the nozzle plate 33, a single nozzle row 32 is caused to correspond to a single color, and the print head 25 is capable of discharging the liquid at a resolution corresponding to the nozzle pitch Py.

As illustrated in FIG. 2, the same number of drive elements 34 as the number of nozzles 31 are embedded in the print head 25. In FIG. 2, a portion of the drive elements 34 is schematically rendered on the outside of the print head 25. However, in actuality, the drive elements 34 are disposed at positions facing the nozzles 31 inside the print head 25. A single discharge unit 35 is configured by a single nozzle 31 and a single drive element 34 which form a group. The same number of (in the example of FIG. 2, eight) discharge unit groups 36 (an example of a drive element group) as the number of nozzle rows 32 are provided in the print head 25 (however, only the single discharge unit group 36 is illustrated in FIG. 2). Each of the discharge unit groups 36 is formed from the same number of discharge units 35 as the number F of the nozzles 31 per single nozzle row, for example.

The number of the discharge unit groups 36 may be one or plural, and in the case of plural, it is possible to change to a value in a range of 2 to 30, for example. The configuration is not limited to one in which the single discharge unit group 36 corresponds to the single nozzle row 32, the single discharge unit group 36 may be configured by a number of the discharge units 35 that is sufficient for two of the nozzle rows 32, and the single nozzle row 32 may be configured to correspond to a plurality of discharge unit groups.

Each of the drive elements 34 illustrated in FIG. 2 is configured by a piezoelectric element, for example. When a drive signal (a drive voltage) having a predetermined waveform (described later) is applied to the drive element 34, a diaphragm which configures a portion of an inner wall portion of a cavity which communicates with the nozzle 31 is caused to vibrate by an electrostriction effect, the cavity is expanded and constricted, and so a droplet is discharged from the nozzle 31. As long as the drive element 34 is driven by the application of a drive signal (a drive voltage), besides a piezoelectric element, the drive element 34 may be an electrostatic drive element which is driven by an electrostatic effect, and further, may be a heater element which uses the pressure (expansion pressure) of a bubble which is generated by heating and boiling a liquid (an ink) to discharge a droplet from a nozzle. In this manner, the print head 25 may be any of a piezoelectric drive type, an electrostatic drive type, or a thermal drive type.

Figure 3:
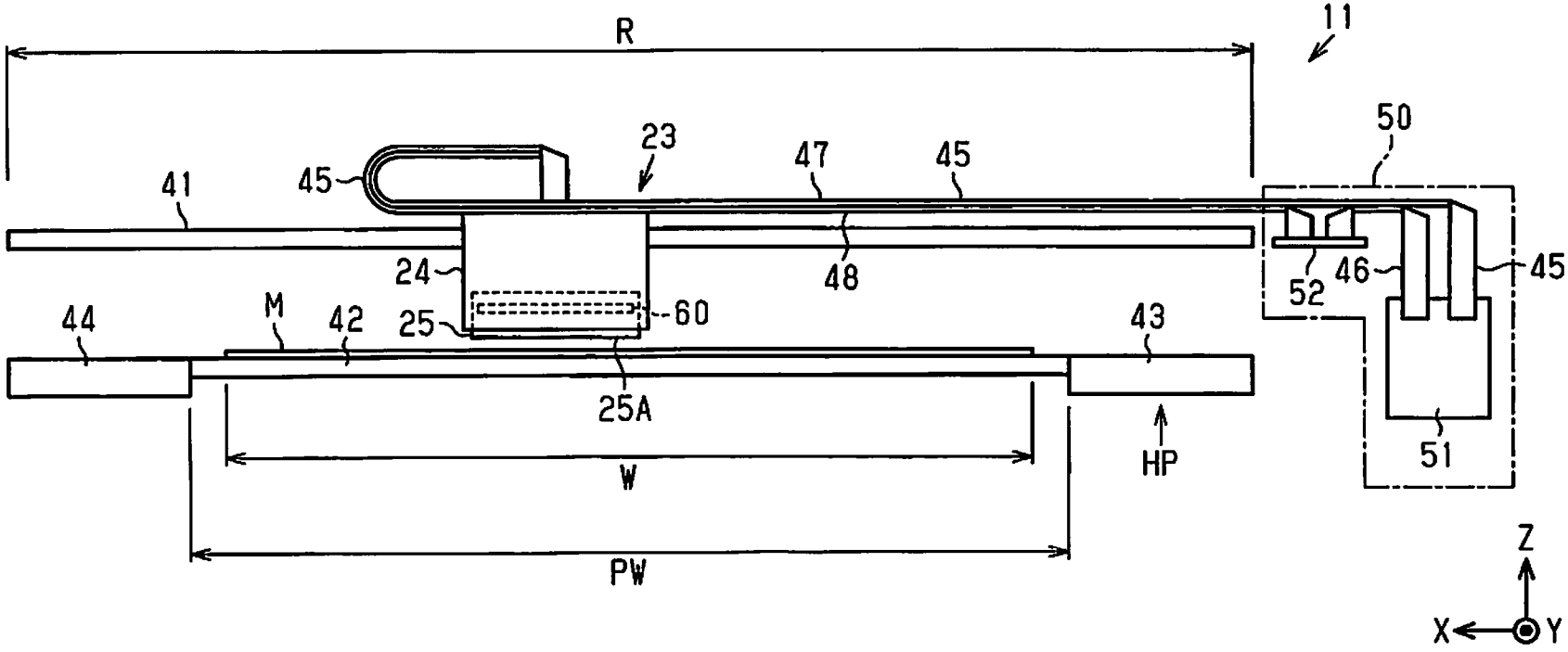
FIG. 3 is a schematic front diagram illustrating a situation in which a control circuit and the print head are connected to each other by a cable.

FIG. 3 illustrates a schematic internal configuration of a portion at which the serial printing is performed in the large format printer 11 as viewed from the downstream side in the sub-scanning direction Y. As illustrated in FIG. 3, the large format printer 11 is provided with the head unit 23, a guide shaft 41, a support stand 42, a capping mechanism 43, and a maintenance mechanism 44.

The head unit 23 moves (reciprocal movement) in the main scanning direction X in a range of a movable region R along the guide shaft 41 based on the control of a carriage movement mechanism (not illustrated). The head unit 23 is disposed in an orientation in which the discharge surface 25A of the print head 25 which is installed on the carriage 24 faces the medium M.

The support stand 42 holds the medium M at a position which is separated by a predetermined distance (a gap) in the discharge direction (in the present example, the vertical direction Z) of the liquid from the discharge surface 25A of the print head 25 when the ink droplets are discharged onto the medium M. The transport unit which is provided in the large format printer 11 includes a plurality of roller pairs (none are illustrated) which transport the medium M which is held by the support stand 42 in the sub-scanning direction Y. The large format printer 11 performs serial printing on the medium M by alternately repeating a printing operation and a transport operation. In the printing operation, the print head 25 discharges ink droplets to perform a single pass (for example, one column) worth of printing onto the medium M through the driving of the transport unit in a process of moving in the main scanning direction X, and in the transport operation, the medium M is transported to the printing position of the next column by the plurality of roller pairs due to the driving of the transport unit. The transport unit may be configured to be provided with a transport belt in addition to or instead of the plurality of roller pairs.

The maximum width (hereinafter referred to as "the maximum printing width") over which the serial printing is possible using the head unit 23 illustrated in FIG. 3 is equal to a support width PW which is a width of the support stand 42 in the main scanning direction X. The support width PW is set to be wider than a standard dimension Ws (the width dimension of the medium of an anticipated maximum standard size) of a medium width W which is the width of the medium M in the main scanning direction X for holding and transporting the medium M in a stable manner. In the present embodiment, the support width PW (that is, the maximum printing width) is less than or equal to 115% of the standard dimension Ws.

In the large format printer 11 of the present embodiment, the maximum width (the maximum printing width) over which the serial printing is possible is 24 inches to 75 inches. For example, the large format printer 11 in which the standard dimension Ws of the medium width W is 24 inches is a printer (referred to as "a 24 inch supporting printer") which supports a maximum printing width of 24 inches, specifically, a printer in which the maximum printing width is greater than 24 inches and less than or equal to 27.6 inches. The large format printer 11 in which the standard dimension Ws of the medium width W is 36 inches is a printer (referred to as "a 36 inch supporting printer") which supports a maximum printing width of 36 inches, specifically, a printer in which the maximum printing width is greater than 36 inches and less than or equal to 41.4 inches. The large format printer 11 in which the standard dimension Ws of the medium width W is 44 inches is a printer (referred to as "a 44 inch supporting printer") which supports a maximum printing width of 44 inches, specifically, a printer in which the maximum printing width is greater than 44 inches and less than or equal to 50.6 inches. The large format printer 11 in which the standard dimension Ws of the medium width W is 64 inches is a printer (referred to as "a 64 inch supporting printer") which supports a maximum printing width of 64 inches, specifically, a printer in which the maximum printing width is greater than 64 inches and less than or equal to 73.6 inches. The configuration is not limited to the maximum printing widths described above and the large format printer 11 may be a large format printer in which a cable 45 is greater than or equal to one meter.

The capping mechanism 43 which seals the discharge surface 25A of the print head 25 is provided at a home position HP which is a starting point of the movement (the reciprocal movement) of the head unit 23 illustrated in FIG. 3. The home position HP is also a position at which the head unit 23 waits when the large format printer 11 is not executing printing.

In the movable region R of the head unit 23, the maintenance mechanism 44 is provided at a location furthest from the home position HP. The maintenance mechanism 44 performs a cleaning process and a wiping process as maintenance processes in a state in which the discharge surface 25A is blocked by a cap (not illustrated). In the cleaning process, ink, bubbles, and the like having increased viscosity inside the nozzles 31 are sucked using a tube pump (not illustrated) through the cap, and in the wiping process, foreign matter such as paper powder which is adhered to the vicinity of the nozzles in the discharge surface 25A is wiped off using a wiper.

The large format printer 11 illustrated in FIG. 3 is provided with a control circuit 50 (a controller) which manages the overall control of the large format printer 11. The control circuit 50 is fixed to a predetermined location inside the main body 14 (refer to FIG. 1). The control circuit 50 of the main body side and the print head 25 are electrically connected to each other via the flexible cable 45. The cable 45 is formed from a flexible flat cable (FFC) for example. The length of the cable 45 which connects the control circuit 50 and the print head 25 to each other is as long as the large format printer 11 in which the maximum width over which serial printing is possible is long. The cable 45 which connects the control circuit 50 and the print head 25 to each other deforms in accordance with the reciprocal movement of the head unit 23 (that is, the print head 25).

The control circuit 50 of the present embodiment is provided with a control substrate 51 and a drive circuit substrate 52. The control substrate 51 and the drive circuit substrate 52 are connected to each other via the cable 45. The cable 45 includes a cable 47 and a cable 48. The cable 47 transmits a plurality of signals which include a control signal and a power voltage signal VHV (refer to FIG. 4) from the control substrate 51 to the print head 25, and the cable 48 transmits a plurality of signals which include drive signals COMA and COMB (refer to FIG. 4) from the drive circuit substrate 52 to the print head 25. A head substrate 60 is installed in the print head 25 illustrated in FIG. 3. The control circuit 50 and the head substrate 60 are connected to each other via the cable 45 (47 and 48).

The drive signals COMA and COMB and print data signals SIn (refer to FIGS. 4 and 5 regarding all of these) which are propagated on the cable 45 from the control circuit 50 are supplied to the head substrate 60. In detail, the print data signals SIn and the power voltage signal VHV which are propagated on the cable 47 from the control substrate 51 are supplied to the head substrate 60 and the drive signals COMA and COMB which are propagated on the cable 48 from the drive circuit substrate 52 are supplied to the head substrate 60. The head substrate 60 drives each of the discharge units 35 (refer to FIG. 2) based on the drive signals COMA and COMB and the print data signal SIn. The print head 25 performs the printing by discharging the liquid (the ink) from each of the nozzles 31 in accordance with variation in the drive signals COMA and COMB which are applied to the drive elements 34 (refer to FIG. 2). The control circuit 50 may be configured by combining the control substrate 51 and the drive circuit substrate 52 into a single substrate. One end of the cable 45 is connected to a terminal on the carriage 24 and the terminal and the head substrate 60 may be connected to each other via a different cable. In summary, any configuration may be adopted as long as the control circuit 50 of the main body side and the print head 25 are connected to each other by the cable 45.

Figure 4:
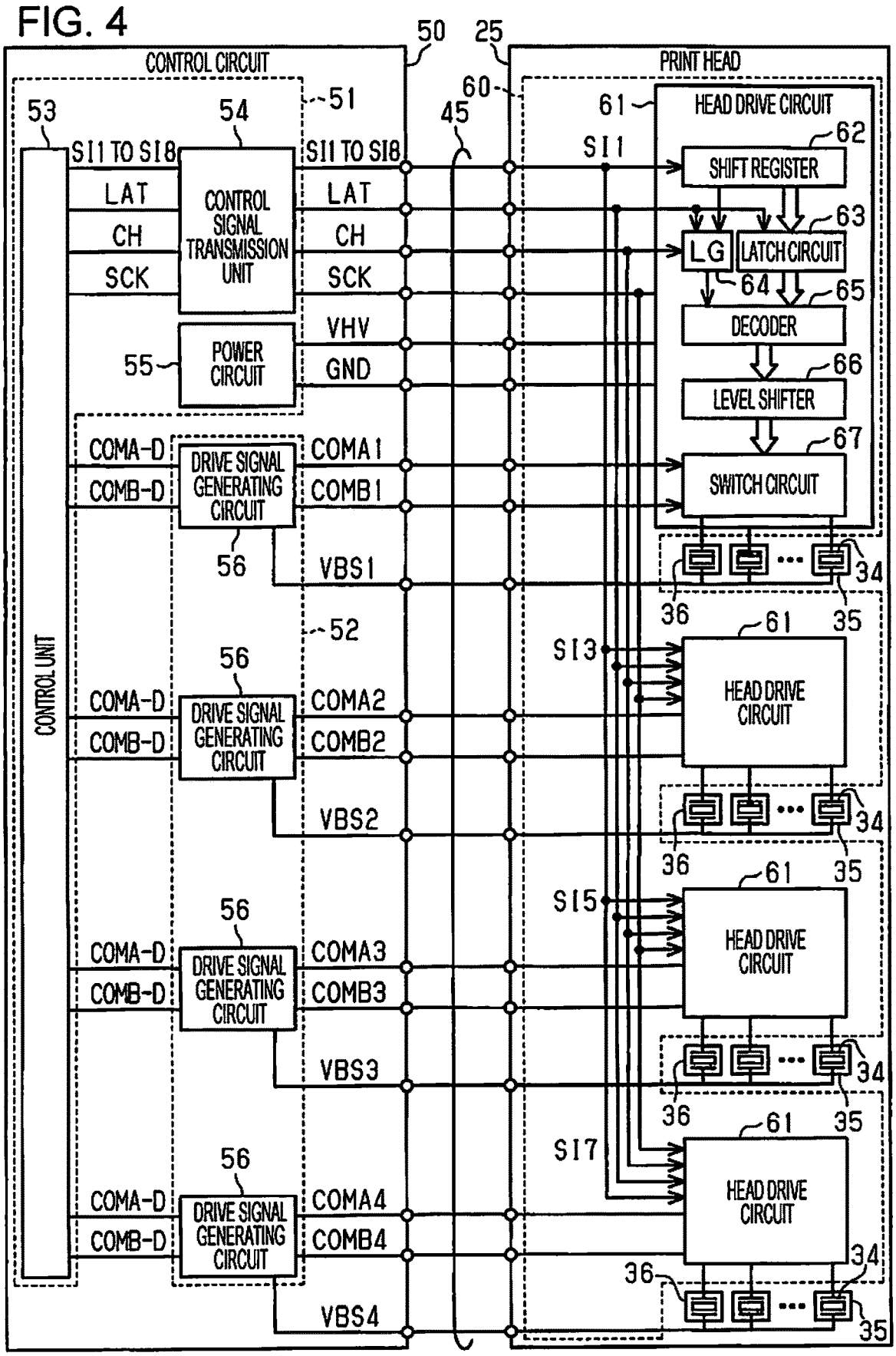
FIG. 4 is a block diagram illustrating the electrical configuration of the large format printer.

FIG. 4 illustrates the electrical configuration of the control system of the print head in the large format printer. As illustrated in FIG. 4, the large format printer 11 is provided with the control circuit 50 print head 25 which are connected to each other via the cable 45 as described earlier. The control circuit 50 includes the control substrate 51 and the drive circuit substrate 52 which are described earlier. A control unit 53, a control signal transmission unit 54, and a power circuit 55 are installed on the control substrate 51. A plurality of (in the example of FIG. 4, four) drive signal generating circuits 56 are installed on the drive circuit substrate 52.

The control unit 53 is realized using a processor such as a micro-controller, for example. The control unit 53 generates a plurality of types of control signal which control the discharging of the liquid from the discharge units 35 based on various types of signal such as the image data from the host computer. The control unit 53 generates a plurality of (for example, eight) print data signals SI1 to SI8, a latch signal LAT, a change signal CH, and a clock signal SCK as the control signals and outputs the control signals to the control signal transmission unit 54. The print data signals SI1 to SI8 are control signals which are used in the discharge control of the ink of a plurality of colors (for example, four colors) and the total of eight of the discharge unit groups 36 are the control targets of the print data signals SI1 to SI8, with two of the print data signals SI1 to SI8 for each color. In other words, the print data signal SIn (where the suffix n=1, 2, . . . , i and i is the nozzle row number) is generated for every discharge unit group 36.

The control signal transmission unit 54 supplies the plurality of print data signals SI1 to SI8, the latch signal LAT, the change signal CH, and the clock signal SCK which are output from the control unit 53 to the head substrate 60 of the print head 25 via the cable 45. The control signal transmission unit 54 generates a differential signal of a low voltage differential signaling (LVDS) transfer type, for example. Since the amplitude of the differential signal of the LVDS transfer type is approximately 350 mV, it is possible to realize high-speed data transfer. The control signal transmission unit 54 may generate differential signals of various high-speed transfer types other than LVDS such as low voltage positive emitter coupled logic (LVPECL) and current mode logic (CML). A high-speed transfer type which does not use a differential signal may also be adopted.

The power circuit 55 illustrated in FIG. 4 generates the power voltage signal VHV of a power voltage (for example, 42 V) and a ground signal GND of a ground voltage (0 V). The power voltage signal VHV is transmitted to the drive signal generating circuits 56 on the drive circuit substrate 52 and is supplied to the circuits including head drive circuits 61 on the head substrate 60 via the cable 45. The ground signal GND is transmitted to the drive signal generating circuits 56 on the drive circuit substrate 52 and is supplied to the circuits including the head drive circuits 61 on the head substrate 60 via the cable 45.

The control unit 53 illustrated in FIG. 4 generates a predetermined number of bits of drive data (waveform data) COMA-D and COMB-D formed from digital data which forms the basis of the drive signals COMA and COMB which drive the discharge units 35 of the print head 25 based on the various signals which are supplied from the host computer. The control unit 53 applies the waveform data COMA-D and COMB-D to the drive signal generating circuits 56 on the drive circuit substrate 52.

The drive signal generating circuits 56 illustrated in FIG. 4 generate the first drive signals COMA based on the predetermined number of bits of the waveform data COMA-D from the control unit 53 and generate the second drive signals COMB based on the waveform data COMB-D. In detail, the drive signal generating circuit 56 generates the first drive signal COMA including at least one waveform by subjecting a digital waveform signal which is generated based on the waveform data COMA-D to D/A conversion and amplifying the result. In detail, the drive signal generating circuit 56 generates the second drive signal COMB including at least one waveform by subjecting a digital waveform signal which is generated based on the waveform data COMB-D to D/A conversion and amplifying the result.

A voltage conversion circuit (not illustrated) which converts the power voltage signal VHV from the power circuit 55 to a power voltage signal GVDD of a constant voltage (for example, 7.5 V) and a low power voltage signal VDD of a constant voltage (for example, 3.3 V) is installed on the drive circuit substrate 52. For example, the voltage conversion circuit supplies the power voltage signal VHV to the drive signal generating circuits 56 and supplies the low power voltage signal VDD to the head substrate 60 via the cable 45. Each of the drive signal generating circuits 56 generates a reference voltage signal VBS of a constant voltage (for example, 6 V) from the power voltage signal GVDD which is output from the voltage conversion circuit. The individual drive signal generating circuits 56 differ from each other only in the waveform data that is input and the drive signal that is output, have the same circuit configuration, and will be described later in detail.

The first drive signal COMA, the second drive signal COMB, and the reference voltage signal VBS which are generated by the drive signal generating circuits 56 illustrated in FIG. 4 are supplied to the head substrate 60 via the cable 45. In the example illustrated in FIG. 4, each of the four drive signal generating circuits 56 generates the first drive signal COMA, the second drive signal COMB, and the reference voltage signal VBS for driving the discharge units 35 which configure the discharge unit groups 36 corresponding to the nozzle rows 32 capable of discharging the ink of the same type (the same color) from among the four types (the four colors) in the print head 25.

In other words, the first drive signal generating circuit 56 generates a first drive signal COMA1, a second drive signal COMB1, and a reference voltage signal VBS1 for driving the two discharge unit groups 36 which correspond to the two nozzle rows 32 which are capable of discharging the ink of a first color. The second drive signal generating circuit 56 generates a first drive signal COMA2, a second drive signal COMB2, and a reference voltage signal VBS2 for driving the two discharge unit groups 36 which correspond to the two nozzle rows 32 which are capable of discharging the ink of a second color. The third drive signal generating circuit 56 generates a first drive signal COMA3, a second drive signal COMB3, and a reference voltage signal VBS3 for driving the two discharge unit groups 36 which correspond to the two nozzle rows 32 which are capable of discharging the ink of a third color. The fourth drive signal generating circuit 56 generates a first drive signal COMA4, a second drive signal COMB4, and a reference voltage signal VBS4 for driving the two discharge unit groups 36 which correspond to the two nozzle rows 32 which are capable of discharging the ink of a fourth color.

The first drive signals COMA1 to COMA4, the second drive signals COMB1 to COMB4, and the reference voltage signals VBS1 to VBS4 which are generated by the drive signal generating circuits 56 are supplied to the head substrate 60 inside the print head 25 via the cable 45. In the print head 25 illustrated in FIG. 4, only half of the number of each of the discharge unit groups 36 and the head drive circuits 61 are illustrated, two of each being provided for every ink color. The first drive signals COMA1 to COMA4 are propagated on twice the number of (eight) wires as the number of (four) wires (core wires) in the cable 45 illustrated in FIG. 4 to the print head 25. The second drive signals COMB1 to COMB4 are propagated on twice the number of (eight) wires as the number of (four) wires (core wires) in the cable 45 illustrated in FIG. 4 to the print head 25. The reference voltage signals VBS1 to VBS4 are propagated on four times the number of (16) wires as the number of (four) wires in the cable 45 illustrated in FIG. 4 to the print head 25 (refer to FIGS. 9 and 14). The drive signals COMA1 to COMA4 which are output from the drive signal generating circuits 56 are all signals of the same waveform and the drive signals COMB1 to COMB4 are all signals of the same waveform. The reference voltage signals VBS1 to VBS4 are all signals of the same constant potential.

In a configuration in which the control circuit 50 performs discharge control on the i (in the present example, eight) discharge unit groups 36, for example, in a case in which the drive signal is a multi-drive type including j types (in the present example, two types) of the drive signals COMA and COMB, i×j (for example, 16) wires inside the cable 45 are used in the propagation of the drive signals COMA and COMB. In other words, two (the number of nozzle rows per color) wires are used for the propagation of each of the first drive signals COMA1 to COMA4 and a total of i (for example, eight) wires are used. Two wires are used for the propagation of each of the second drive signals COMB1 to COMB4 and a total of i (for example, eight) wires are used. Four wires are used for the propagation of each of the reference voltage signals VBS1 to VBS4 and a total of i×j (for example, 16) wires are used. The control circuit 50 may be a single drive type in which the discharge control is performed using one type of the drive signal COM, for example, and in this case, i wires inside the cable 45 are used in the propagation of the drive signal COM and i wires are used in the propagation of the reference voltage signal VBS. In the following description, in a case in which the four types of signal for every ink color are not particularly to be distinguished, the signals will be denoted simply as the first drive signal COMA, the second drive signal COMB, and the reference voltage signal VBS.

The control unit 53 generates the waveform data COMA-D and COMB-D according to a temperature signal TH (not illustrated) which is propagated from the print head 25 (the head substrate 60) via the cable 45 such that the waveforms of the drive signals COMA and COMB are corrected. In a case in which an abnormality signal XHOT which is propagated from the print head 25 (the head substrate 60) through the cable 45 is a signal value (for example, a high level) indicating an abnormality, the control unit 53 stops the supplying of the waveform data COMA-D and COMB-D to the drive signal generating circuits 56 and stops the discharging of the droplets from the print head 25.

In addition to the processes described above, the control unit 53 controls the movement of the head unit 23 in the main scanning direction X by ascertaining the scanning position (the current position) of the head unit 23 (that is, the carriage 24) and performing drive control on a carriage motor (not illustrated) based on the scanning position of the head unit 23. The control unit 53 controls the movement of the medium M in the sub-scanning direction Y by performing drive control on a transport motor (not illustrated) which is a motive force source of the transport unit. The control unit 53 causes the maintenance mechanism 44 (refer to FIG. 3) to execute a maintenance process (a cleaning process and a wiping process).

As illustrated in FIG. 4, corresponding to the eight discharge unit groups 36, eight (however, only four are illustrated in FIG. 4) of the head drive circuits 61 are installed on the head substrate 60. A control signal reception unit (not illustrated) which differentially amplifies each of the differential signals which are propagated via the cable 45 and converts the results to the print data signals SI1 to SI8, the latch signal LAT, the change signal CH, and the clock signal SCK which are single ended signals is provided on the head substrate 60. The print data signals SI1 to SI8 are supplied to the corresponding head drive circuits 61 and are used in the discharge control of the eight discharge unit groups 36. The latch signal LAT, the change signal CH, and the clock signal SCK are supplied in common to the head drive circuits 61.

Each of the head drive circuits 61 generates, and outputs to the corresponding discharge unit 35, a drive signal VOUT (refer to FIG. 7) which is provided for every discharge unit 35 which configures the corresponding discharge unit group 36 based on the corresponding one of the print data signals SI1 to SI8, the latch signal LAT, the change signal CH, the clock signal SCK, and the drive signals COMA and COMB. The drive signal VOUT is applied to one end of the drive element 34 which configures the discharge unit 35 and the reference voltage signal VBS is applied to the other end. Each of the drive elements 34 is displaced according to the potential difference between the drive signal VOUT and the reference voltage signal VBS which are applied to discharge the liquid.

Since the circuit configuration of each of the head drive circuits 61 illustrated in FIG. 4 is the same, FIG. 4 illustrates the detailed circuit configuration of only the single head drive circuit 61 to which the print data signal SI1 is input. As illustrated in FIG. 4, the head drive circuit 61 is provided with a shift register 62, a latch circuit 63, a control logic 64, a decoder 65, a level shifter 66, and a switch circuit 67.

Hereinafter, in describing the configuration and the operations of the head drive circuit 61, first, a detailed description will be given of the first drive signal COMA, the second drive signal COMB, the print data signals SI1 to SIB, the latch signal LAT, the change signal CH, and the clock signal SCK, which are input to the head drive circuit 61 with reference to FIG. 5.

Figure 5:
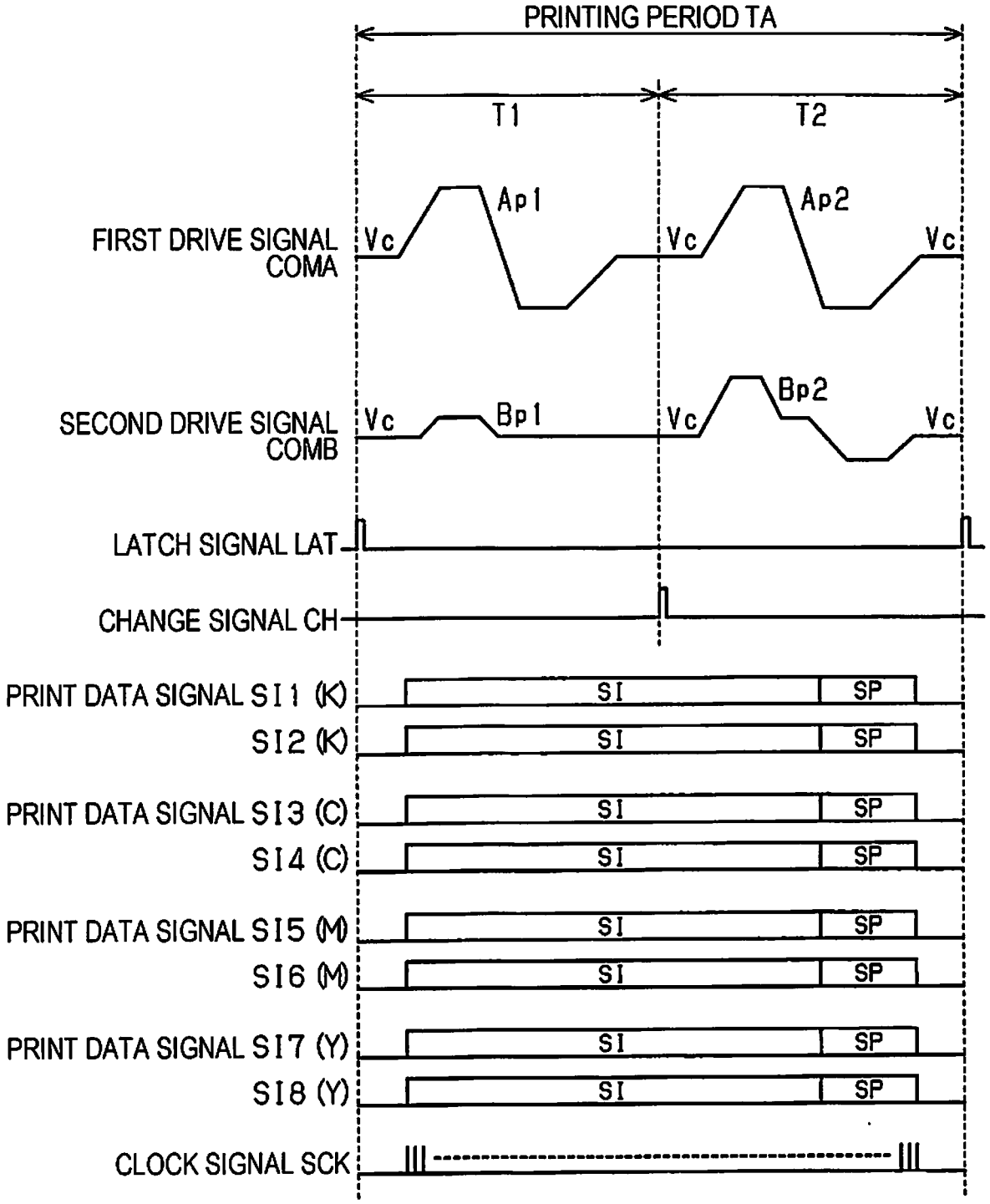
FIG. 5 is a timing chart illustrating a first drive signal, a second drive signal, a latch signal, a change signal, and print data signals.

FIG. 5 illustrates the first drive signal COMA, the second drive signal COMB, the print data signals SI1 to SI8, the latch signal LAT, the change signal CH, and the clock signal SCK in a printing period TA which is a discharge period of a droplet for forming one dot (one printed pixel). In the example illustrated in FIG. 5, the printing period TA is divided into a duration T1 from the rise of the latch signal LAT until the rise of the change signal CH and a duration T2 from the rise of the change signal CH until the rise of the next latch signal LAT.

As illustrated in FIG. 5, the first drive signal COMA is an analog signal in which a waveform Ap1 (a drive pulse) which serves as an example of a first waveform which is disposed in the duration T1 and a waveform Ap2 (a drive pulse) which serves as an example of a first waveform which is disposed in the duration T2 are consecutive. In this example, the two waveforms Ap1 and Ap2 are waveforms which are substantially the same as each other. In detail, the waveforms Ap1 and Ap2 are waveforms in which, using a predetermined center potential Vc as a reference, a mountain-shaped trapezoidal waveform (a mountain portion) and a valley-shaped trapezoidal waveform (a valley portion) are consecutive in time series order.

As illustrated in FIG. 5, the second drive signal COMB is an analog signal in which a trapezoidal waveform Bp1 (a drive pulse) which serves as an example of a second waveform which is disposed in the duration T1 and a trapezoidal waveform Bp2 (a drive pulse) which serves as an example of a second waveform which is disposed in the duration T2 are consecutive in time series order. In this example, the two waveforms Bp1 and Bp2 are waveforms which are different from each other. Of these, the trapezoidal waveform Bp1 is a waveform for suppressing an increase in the viscosity of the ink by subjecting the ink in the vicinity of the opening portion of the nozzle 31 to micro-vibrations. Therefore, even if, hypothetically, the trapezoidal waveform Bp1 is supplied to one end of the drive element 34, the ink droplet is not discharged from the nozzle 31 corresponding to the drive element 34. The waveform Bp2 is a waveform having a different shape from the waveform Ap1 (Ap2), and is a waveform in which the mountain-shaped trapezoidal wave (the mountain portion) which uses the center potential Vc as a reference and the valley-shaped trapezoidal wave (the valley portion) are consecutive in time series order. In a case in which the waveform Bp2 is supplied to one end of the drive element 34, it is possible to discharge an ink droplet of a smaller amount than a predetermined amount that is discharged from the nozzle 31 corresponding to the drive element 34 when the waveform Ap1 or Ap2 is supplied to one end of the drive element 34. The voltages at the start timing and the voltages at the end timing of the waveforms Ap1, Ap2, Bp1, and Bp2 are all the center potential Vc in common. In other words, the waveforms Ap1, Ap2, Bp1, and Bp2 are all waveforms that rise from the center potential Vc and return to the center potential Vc.

Incidentally, for the method of forming dots on the medium M, although there is a method (the first method) of discharging an ink droplet one time to form one dot, other methods exist. For example, assuming it is possible to discharge ink droplets two or more times in a unit duration (the printing period TA), there are a method (a second method) of forming a single dot by causing two or more ink droplets which are discharged in a unit duration to land and bonding the two or more landed ink droplets, and a method (a third method) of forming two or more dots without bonding the two or more ink droplets.

In the present embodiment, according to the second method, four-level gradation of "large dot", "medium dot", "small dot", and "non-recording (no dot)" is expressed by discharging the ink a maximum of two times for a single dot. In order to express the four levels of gradation, in the present embodiment, two types of the drive signal COMA and COMB are prepared, and each of the drive signals COMA and COMB holds an early half waveform pattern and a latter half waveform pattern in the single period TA. A configuration is adopted in which, in the durations T1 and T2 of the early half and the latter half in a single period, the drive signals COMA and COMB are selected or not selected according to the gradation to be expressed and the drive signal VOUT which includes a waveform, which is determined by the selection or non-selection of the drive signals COMA and COMB, is supplied to the drive element 34.

As illustrated in FIG. 5, each of the print data signals SI1 to SI8 (SIn) included discharge data SI and definition data SP for waveform selection. In detail, each of the print data signals SI1 to SI8 includes discharge data SI and definition data SP. The discharge data SI contains a number of items of two-bit dot data for causing the discharge unit 35 to form a single pixel (a dot) equal to the number of nozzles (for example, 400) sufficient for one nozzle row, and the definition data SP is for the decoder 65 (FIG. 4) to convert the dot data into the drive signal VOUT which causes the switch circuit 67 to turn on and off. The discharge data SI is configured by high-order bit data SIHn and low-order bit data SILn. In the high-order bit data SIHn, only high-order bits SIH of the dot data (SIH, SIL) which is represented by two bits per single pixel are collected in a number sufficient for the number of nozzles in a single nozzle row, and in the low-order bit data SILn, only low-order bits SIL are collected in a number sufficient for the number of nozzles. The definition data SP is data of a predetermined number of bits (for example, four bits) which defines the correspondence relationship between the two-bit dot data (SIH, SIL) in the discharge data SI and the waveform which is selected from among the waveforms Ap1, Ap2, Bp1, and Bp2 (the drive pulse) in the drive signals COMA and COMB. The clock signal SCK is output in the same output duration as the print data signals SI1 to SI8.

Next, a description will be given of the configuration and the operations of the head drive circuit 61 illustrated in FIG. 4. The print data signals SIn are input to each of the shift registers 62 in the head drive circuits 61. The shift register 62 is provided with a first shift register (first SR), a second shift register (second SR), and a third shift register (third SR) which are not illustrated. The high-order bit data SIHn inside the print data signal SIn is stored in the first SR and the low-order bit data SILn is stored in the second SR. The definition data SP inside the print data signal SIn is stored in the third SR.

The latch circuit 63 illustrated in FIG. 4 receives input of the latch signal LAT, holds the discharge data SI (SIHn, SILn) from the shift register 62 (the first SR and the second SR) based on the latch signal LAT and outputs the discharge data SI which is held until this time at every timing of the printing period TA to the decoder 65.

The change signal CH from the control circuit 50 and the definition data SP from the shift register 62 are input to the control logic 64 illustrated in FIG. 4. The control logic 64 translates the definition data SP and transmits real value table data RD illustrated in FIG. 6 to the decoder 65 at the timing of the change signal CH.

Figures 6, 7:
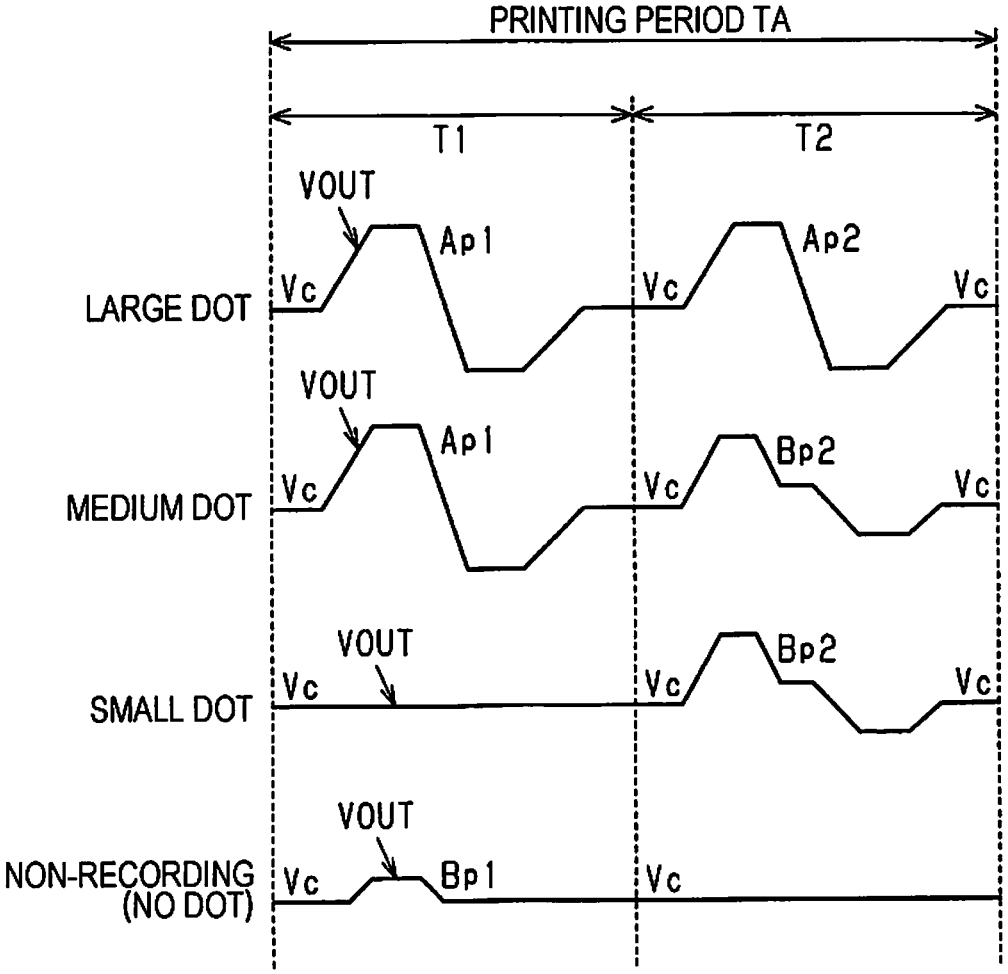
FIG. 6 is a table illustrating decoded content in a decoder.
FIG. 7 is a signal waveform diagram illustrating a relationship between the drive signal that is applied to the drive element and droplet size.

The decoder 65 illustrated in FIG. 4 refers to the real value table data RD illustrated in FIG. 6, decodes the two-bit dot data (SIH, SIL) in the discharge data SI which is input from the latch circuit 63 for every duration T1 and T2, and outputs two-bit selection signals Sa and Sb for every duration T1 and T2. If the input dot data (SIH, SIL) is (1, 1) (large dot), for example, the decoder 65 outputs the logical levels of the selection signals Sa and Sb as (H, L) levels in the duration T1 and as (H, L) levels in the duration T2. If the dot data (SIH, SIL) is (1, 0) (medium dot), the decoder 65 outputs the logical levels of the selection signals Sa and Sb as (H, L) levels in the duration T1 and as (L, H) levels in the duration T2. If the dot data (SIH, SIL) is (0, 1) (small dot), the decoder 65 outputs the logical levels of the selection signals Sa and Sb as (L, L) levels in the duration T1 and as (L, H) levels in the duration T2. If the dot data (SIH, SIL) is (0, 0) (non-recording), the decoder 65 outputs the logical levels of the selection signals Sa and Sb as (L, H) levels in the duration T1 and as (L, L) levels in the duration T2. The two-bit selection signals Sa and Sb which the decoder 65 outputs for every duration T1 and T2 are sequentially input to the switch circuit 67 via the level shifter 66.

The level shifter 66 functions as a voltage amplifier and raises the voltage levels of the selection signals Sa and Sb and outputs the results. In a case in which the selection signals Sa and Sb are at the "H" level, the level shifter 66 outputs an electrical signal in which the voltage is raised to approximately several tens of volts (for example, a maximum of approximately 40 V), for example, which is capable of driving the switch circuit 67, and in a case in which the selection signals Sa and Sb are at the "L" level, the level shifter 66 outputs an electrical signal of a L level in a similar manner. In other words, the level shifter 66 level shifts the selection signals Sa and Sb which are input from the decoder 65 to a logical level of a higher amplitude. The selection signals Sa and Sb which are output from the level shifter 66 are input to the switch circuit 67.

The drive signals COMA and COMB which are propagated from the drive signal generating circuit 56 via the cable 45 and the selection signals Sa and Sb which are raised via the level shifter 66 from the decoder 65 are input to the switch circuit 67 illustrated in FIG. 4. Here, of the selection signals Sa and Sb of the duration T1, the selection signal Sa is a signal which defines the selection or the non-selection of a drive pulse Ap1 in the duration T1 in the first drive signal COMA illustrated in FIG. 5, and the selection signal Sb is a signal which defines the selection or the non-selection of a drive pulse Bp1 in the duration T1 in the second drive signal COMB. Of the selection signals Sa and Sb of the duration T2, the selection signal Sa is a signal which defines the selection or the non-selection of a drive pulse Ap2 in the duration T2 in the first drive signal COMA, and the selection signal Sb is a signal which defines the selection or the non-selection of a drive pulse Bp2 in the duration T2 in the second drive signal COMB.

Figure 8:
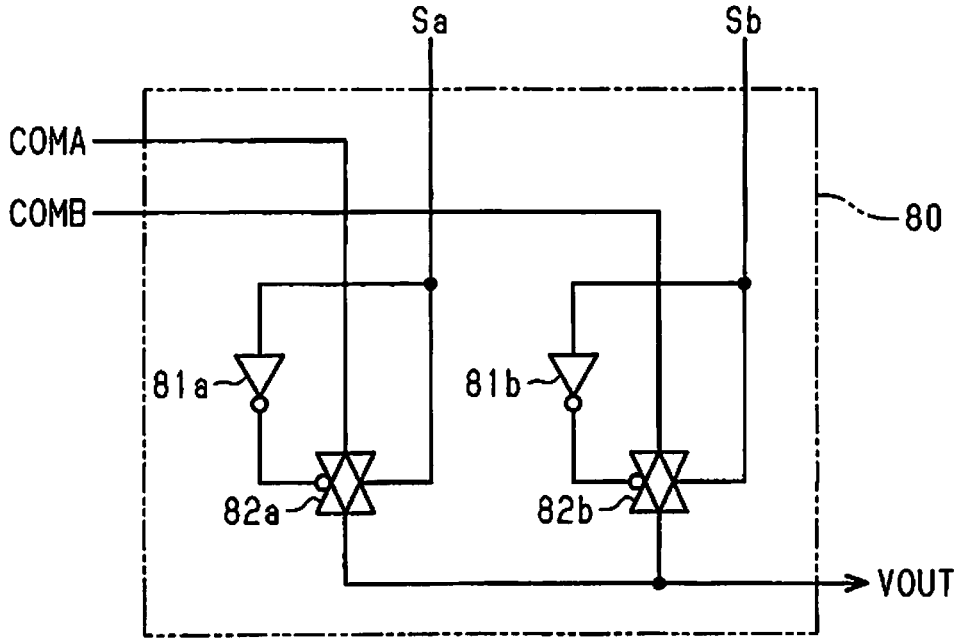
FIG. 8 is a circuit diagram illustrating the configuration of a selection unit.

The switch circuit 67 illustrated in FIG. 4 is provided with a selection unit 80 illustrated in FIG. 8 in the same number (m) as a total number m of the drive elements 34 (that is, the nozzles 31) per single nozzle row. The m selection units 80 select the drive pulses to be applied to the drive elements 34 from the drive signals COMA and COMB for every duration T1 and T2 based on the selection signals Sa and Sb.

FIG. 8 illustrates the configuration of the selection unit 80. As illustrated in FIG. 8, the selection unit 80 includes inverters (NOT circuits) 81*a* and 81*b* and transfer gates 82*a* and 82*b*. While the selection signal Sa from the decoder 65 is supplied to the positive control terminal that does not have a circle mark in the transfer gate 82*a*, the selection signal Sa is logically inverted by the inverter 81*a* and is supplied to the negative control terminal that has a circle mark in the transfer gate 82*a*. In the same manner, while the selection signal Sb is supplied to the positive control terminal of the transfer gate 82*b*, the selection signal Sb is logically inverted by the inverter 81*b* and is supplied to the negative control terminal of the transfer gate 82*b*.

The first drive signal COMA is supplied to the input terminal of the transfer gate 82*a* and the second drive signal COMB is supplied to the input terminal of the transfer gate 82*b*. The output terminals of the transfer gates 82*a* and 82*b* are connected to each other in common and the drive signal VOUT is output to the discharge unit 35 via the common connection terminal.

The transfer gate 82*a* causes between the input terminal and the output terminal to conduct (turn on) if the selection signal Sa is the H level and causes between the input terminal and the output terminal to not conduct (turn off) if the selection signal Sa is the L level. In the same manner, even for the transfer gate 82*b*, between the input terminal and the output terminal is caused to turn on and off according to the selection signal Sb.

FIG. 7 is a diagram illustrating waveforms of the drive signals VOUT which are output by the selection unit 80. As illustrated in FIG. 6, the selection unit 80 selects the drive pulse Ap1 in the first drive signal COMA in the duration T1 and selects the drive pulse Ap2 in the first drive signal COMA in the duration T2, and so the drive signal VOUT corresponding to "the large dot" is generated. When the drive signal VOUT is supplied to one end of the drive element 34, approximately a medium amount of a droplet (an ink droplet) is divided into two and discharged from the nozzle 31 during the period TA. Therefore, the droplets land on the medium M and combine with each another to form the large dot.

The selection unit 80 selects the drive pulse Ap1 in the first drive signal COMA in the duration T1 and selects the drive pulse Bp2 in the second drive signal COMB in the duration T2, and so the drive signal VOUT corresponding to "the medium dot" is generated. When the drive signal VOUT is supplied to one end of the drive element 34, approximately a medium amount and approximately a small amount of a droplet (an ink droplet) is divided into two and discharged from the nozzle 31 during the period TA. Therefore, the droplets land on the medium M and combine with each another to form the medium dot.

In the duration T1, the selection unit 80 does not select either waveform from among the drive signals COMA and COMB and the drive element 34 assumes the voltage Vc from directly prior which is held by the capacitance of the drive element 34, and in the duration T2, the selection unit 80 selects the drive pulse Bp2 in the second drive signal COMB, and so the drive signal VOUT corresponding to "the small dot" is generated. When the drive signal VOUT is supplied to one end of the drive element 34, approximately a small amount of droplets (the ink droplets) are discharged in only the duration T2 from the nozzle 31 during the period TA. Therefore, the droplet lands on the medium M to form the small dot.

The selection unit 80 selects the drive pulse Bp1 which is a trapezoidal waveform inside the second drive signal COMB in the duration T1, and in the duration T2, the selection unit 80 does not select either waveform from among the drive signals COMA and COMB and the drive element 34 assumes the voltage Vc from directly prior which is held by the capacitance of the drive element 34, and so the drive signal VOUT corresponding to "non-recording" is generated. When the drive signal VOUT is supplied to one end of the drive element 34, the nozzle 31 only performs micro-vibrations in the duration T1 during the printing period TA and the ink is not discharged. Therefore, the dot is not formed on the medium M.

The large format printer 11 of the present embodiment is designed in anticipation of printing greater than or equal to a defined number of sheets (for example, two sheets) every minute of printed matter of A3 short side width size (for example, A3 pages) at a defined printing resolution (for example 5760×1440 dpi) using 400 or 800 drive elements 34 per single color. In order to satisfy the printing conditions, the discharge units 35 of the print head 25 are capable of discharging the liquid at a frequency greater than or equal to 30 kHz to perform the printing.

In the present embodiment, the drive signal generating circuit 56 generates a digital waveform signal based on the waveform data COMA-D and COMB-D which are the digital signals that are input. The drive signal generating circuit 56 is provided with a digital amplifier (not illustrated) which outputs the drive signals COMA and COMB by converting the digital waveform signals into analog signals and amplifying the result. The digital amplifier is provided with a digital analog converter (DAC) and an amplifying circuit (both not illustrated), for example.

Incidentally, when the waveform data COMA-D and COMB-D are subjected to frequency spectral analysis, there is a peak at approximately 60 kHz, for example, and frequencies of approximately 10 kHz to 400 kHz are included. Here, it is necessary that the drive signals COMA and COMB substantially faithfully reproduce the waveforms of the drive data COMA-D and COMB-D while suppressing jaggies. In order to amplify the drive signals COMA and COMB using the digital amplifier, it is necessary to drive the digital amplifier at a switching frequency greater than or equal to ten times that of the frequency component that is included in the pre-amplification drive signal at a minimum. Since most components are less than 100 kHz, it is desirable to use a digital amplifier capable of being driven at a switching frequency of approximately 1 MHz at a minimum, which is ten times 100 kHz, for the DAC of the drive signal generating circuit 56. When the power voltage VHV is set to 42 V, for example, it is necessary for the amplitude of the drive signals COMA and COMB to be a wide range of approximately 2 V to 37 V. In order to secure the waveform quality and perform the pulse modulation, there is a demand for driving using a modulated signal of a megahertz-order high frequency. Therefore, in the present embodiment, a pulse density modulation type DAC that is suitable for high-frequency driving is adopted rather than the pulse width modulation type. The DAC is not limited to the pulse density modulation type and may be any modulation type that can handle megahertz-order high-frequency driving.

Figure 9:
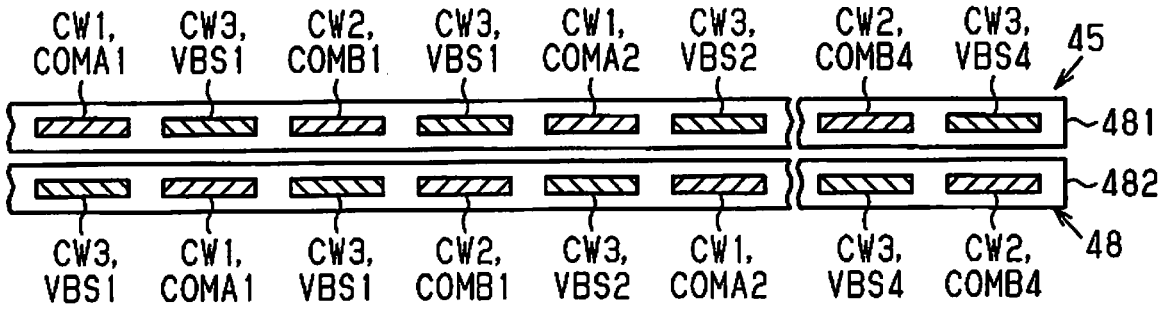
FIG. 9 is a schematic sectional diagram in which a portion of a cable on which the drive signals are propagated is cut along a width direction.

Next, a description will be given of the configuration of the cable 48 which is used in the propagation of the drive signals COMA, COMB, and the like with reference to FIG. 9. In FIG. 9, only a portion of the portion (a drive signal wire region WA (FIG. 14)) of wires CW1 to CW3 on which the first drive signal COMA, the second drive signal COMB, and the reference voltage signal VBS are propagated is illustrated, and the signals illustrated inside brackets ( ) in FIG. 9 are propagated on the wires CW1 to CW3.

As illustrated in FIG. 9, the cable 48 which configures the cable 45 has a length greater than or equal to 1 m and includes a plurality of wires (core wires) which include the wires CW1, CW2, and CW3 for the propagation of various signals. The cable 48 of this example includes a first flat cable 481 which serves as an example of a first cable and a second flat cable 482 which serves as an example of a second cable which are illustrated in FIG. 9. The two flat cables 481 and 482 are in an overlapping state. A plurality of wires (core wires) extend parallel to each other along the cable longitudinal direction (a direction orthogonally intersecting the paper surface of FIG. 9) in the first flat cable 481. The plurality of wires include the first wires CW1 on which the first drive signals COMA1 to COMA4 are propagated, the second wires CW2 on which the second drive signals COMB1 to COMB4 are propagated, and the third wires CW3 on which the reference voltage signals VBS1 to VBS4 are propagated. A plurality of wires (core wires) extend parallel to each other along the cable longitudinal direction (a direction orthogonally intersecting the paper surface of FIG. 9) in the second flat cable 482. The plurality of wires include the first wires CW1 on which the first drive signals COMA1 to COMA4 are propagated, the second wires CW2 on which the second drive signals COMB1 to COMB4 are propagated, and the third wires CW3 on which the reference voltage signals VBS1 to VBS4 are propagated. The plurality of wires CW1, CW2, and CW3 are disposed at a fixed interval in the width direction (the wire arrangement direction) of the cables 481 and 482.

In the first flat cable 481 and the second flat cable 482, the first wires CW1 are adjacent to the third wires CW3, and the second wires CW2 are adjacent to the third wires CW3 in the width direction. In other words, in the first flat cable 481 and the second flat cable 482, the first wires CW1 and the second wires CW2 are disposed at positions one apart from each other, and the third wires CW3 are disposed between both the wires CW1 and CW2. In other words, the third wires CW3 are disposed at every other position, and the first wires CW1 and the second wires CW2 are disposed on both sides of the third wires CW3.

As illustrated in FIGS. 9 and 14, the first flat cable 481 includes the four first wires CW1 on which the first drive signals COMA1 to COMA4 are propagated, the four second wires CW2 on which the second drive signals COMB1 to COMB4 are propagated, and the eight third wires CW3 on which the reference voltage signals VBS1 to VBS4 are propagated, two wires for each reference voltage signal. In the same manner as the first flat cable 481, the second flat cable 482 includes the four first wires CW1 on which the first drive signals COMA1 to COMA4 are propagated, the four second wires CW2 on which the second drive signals COMB1 to COMB4 are propagated, and the eight third wires CW3 on which the reference voltage signals VBS1 to VBS4 are propagated, two wires for each reference voltage signal. In other words, a total of 32 of the wires CW1 to CW3 for drive signal propagation are prepared in the first flat cable 481 and the second flat cable 482.

Here, for the inks to be used, k colors (in this example, k=4) are used, and Q (in this example, two) of the nozzle rows 32 are used per one color. In a case in which a multi-drive system is adopted in which j types (in this example, two types) of drive signal, the first drive signal and the second drive signal, are used, the total number of nozzle rows (the total number of the discharge unit groups 36) is k×Q (=i), and at minimum, one of the first drive signals COMA, one of the second drive signals COMB, and one of the reference voltage signals VBS are necessary for the driving control of one of the discharge unit groups 36. In order to adopt the signal sequences illustrated in FIGS. 9 and 14, the same number (2×i) of the third wires CW3 is necessary as the total of the number (i) of the first wires CW1 and the number (i) of the second wires CW2, and a total of 4×i wires are necessary in the cable 48.

As illustrated in FIGS. 9 and 14, in the present embodiment, in the two flat cables 481 and 482, the drive signal wire regions WA (hereinafter also referred to simply as "the wire region WA") illustrated in FIG. 14, which include 2×i wires each in the position regions facing each other, are secured. In the example illustrated in FIG. 9, two (Q) of the first drive signals COMA1, two (Q) of the second drive signals COMB1, and four (2×Q) reference voltage signals VBS1 are propagated for the first color among the k colors (in this example, four colors). In the same manner, two of the first drive signals COMA2, two of the second drive signals COMB2, and four of the reference voltage signals VBS2 are propagated for the second color. Two of the first drive signals COMA3, two of the second drive signals COMB3, and four of the reference voltage signals VBS3 are propagated for the third color. Two of the first drive signals COMA4, two of the second drive signals COMB4, and four of the reference voltage signals VBS4 are propagated for the fourth color. Two first drive signals COMAα, two second drive signals COMBα, and four reference voltage signals VBSα are propagated for an α-th color (where α=1, 2, . . . , k).

As illustrated in FIGS. 9 and 14, the wire region WA (refer to FIG. 14) in the first flat cable 481 includes 2×i wires for the propagation of the signals COMA1, VBS1, COMB1, VBS1, COMA2, VBS2, COMB2, VBS2, . . . , COMAk, VBSk, COMBk, and VBSk in order from one end side (the left side in FIG. 9). Therefore, 2×i (in this example, 16) wires are arranged in the first flat cable 481 in order of the wires CW1, CW3, CW2, CW3, . . . , CW1, CW3, CW2, and CW3 from one end side (the left side) in FIG. 9. The wire region WA (refer to FIG. 14) in the second flat cable 482 includes 2×i wires for the propagation of the signals VBS1, COMA1, VBS1, COMB1, VBS1, COMA2, VBS2, COMB2, VBS2, VBSk, COMAk, VBSk, and COMBk in order from one end side (the left side in FIG. 9). Therefore, 2×i (in this example, 16) wires are arranged in the second flat cable 482 in order of the wires CW3, CW1, CW3, CW2, CW3, . . . , CW2, CW3, CW1, CW3, and CW2 from one end side (the left side) in FIG. 9. Accordingly, as illustrated in FIGS. 9 and 14, the two flat cables 481 and 482 overlap each other in a state in which the first wires CW1 mutually face the third wires CW3 of the partner side and the second wires CW2 mutually face the third wires CW3 of the partner side.

In this manner, in this example in which the signals are transferred by multi-drive type using the plurality of flat cables 481 and 482, the drive signals COM (COMA and COMB) and the reference voltage signals VBS are sequenced alternately inside the flat cables 481 and 482. The first drive signals COMA and the second drive signals COMB are present in all of the plurality of flat cables 481 and 482. In a state in which the plurality of flat cables 481 and 482 overlap, the drive signals COM (COMA and COMB) face (overlap) the reference voltage signals VBS. Signals of the same ink type, that is, signals in which the suffix a (a number) of the signals COMAα, VBSα, and COMBα is the same are disposed to be adjacent inside the flat cables 481 and 482.

In this example, the two discharge unit groups 36 for the first color are driven by the print data signals SI1 and SI2, respectively, and the common signals COMA1, COMB1, and VBS1. The two discharge unit groups 36 for the second color are driven by the print data signals SI3 and SI4, respectively, and the common signals COMA2, COMB2, and VBS2. The two discharge unit groups 36 for the third color are driven by the print data signals SI5 and SI6, respectively, and the common signals COMA3, COMB3, and VBS3. The two discharge unit groups 36 for the fourth color are driven by the print data signals SI7 and SI8, respectively, and the common signals COMA4, COMB4, and VBS4.

Since the drive signals COMA1 to COMA4 and COMB1 to COMB4 are high-frequency signals including waveforms for every duration T1 and T2 which is half of the printing period TA, when the distance between the wires on which the signals are propagated is close, overshooting occurs easily due to mutual induction. In particular, when the first drive signals COMA1 to COMA4 which include the first waveform which has a greater amplitude than the second waveform which is included in the second drive signals COMB1 to COMB4 are propagated at comparatively close positions to each other, overshooting occurs easily.

Therefore, in the present example, as illustrated in FIG. 9, the first wires CW1 for the first drive signals COMA1 to COMA4 and the second wires CW2 for the second drive signals COMB1 to COMB4 are sequenced alternately in ascending order of the suffix number (the number of the color type) in the cable width direction. The third wires CW3 for the reference voltage signals VBS1 to VBS4 which have the same suffix number are disposed between the first wires CW1 and the second wires CW2. Accordingly, the first drive signals COMA1 to COMA4 and the second drive signals COMB1 to COMB4 are propagated at positions which are separated by a distance corresponding to twice the pitch of the wire pitch in the cable width direction. The first drive signals COMA are propagated at positions which are separated by a distance corresponding to four times the wire pitch from each other, and the same applies to the second drive signals COMB. The reference voltage signals VBS1 to VBS4 of a constant voltage are propagated at positions between the drive signals COMA and COMB.

As illustrated in FIG. 9, in the present embodiment, the third wires CW3 are disposed between the first wires CW1 and the second wires CW2 in the width direction in each of the flat cables 481 and 482. In a state in which the two flat cables 481 and 482 overlap each other, the first wires CW1 mutually face the third wires CW3 of the partner side and the second wires CW2 mutually face the third wires CW3 of the partner side. Therefore, the first drive signals COMA1 to COMA4 and the second drive signals COMB1 to COMB4 face the reference voltage signals VBS1 to VBS4 in the cable thickness direction (the overlapping direction).

In order to adopt the signal sequences, as illustrated in FIGS. 9 and 14, if one end (the top end in FIG. 14) of the first flat cable 481 in the width direction in the wire region WA is the first drive signal COMA1, the one end of the second flat cable 482 in the width direction in the width direction in the wire region WA is the reference voltage signal VBS1 and the position adjacent to the one end on the other end side is the first drive signal COMA1. The other end (the bottom end in FIG. 14) of the first flat cable 481 in the width direction in the wire region WA is the reference voltage signal VBS4 and the position adjacent (the second from the bottom in FIG. 14) to the other side on the one end side is the second drive signal COMB4 and the other end of the second flat cable 482 in the width direction in the wire region WA is the second drive signal COMB4.

As illustrated in FIG. 14, the region sufficient for eight wires (four levels in FIG. 14) on the one end (the top level) side of the cable 48 is a sequence block of the signals COMA1, COMB1, and VBS1 which are used in the printing of the first color. The one end side half (the two levels worth on the top side in FIG. 14) inside the sequence block is a sequence block of the signals COMA1 and VBS1 and the other end side half (the two levels worth on the bottom side in FIG. 14) is a sequence block of the signals COMB1 and VBS1. The region sufficient for the next eight wires (four levels in FIG. 14) positioned adjacent to the one end on the other end side is a sequence block of the signals COMA2, COMB2, and VBS2 which are used in the printing of the second color, and the region sufficient for the next eight wires (four levels in FIG. 14) positioned adjacent to the one end further on the other end side is a sequence block of the signals COMA3, COMB3, and VBS3 which are used in the printing of the third color. The region sufficient for eight wires (four levels in FIG. 14) positioned at the most other end side is a sequence block of the signals COMA4, COMB4, and VBS4 which are used in the printing of the fourth color. For the sequence blocks of the second color, the third color, and the fourth color, the one end side half (the two levels worth on the top side in FIG. 14) in the cable width direction is a sequence block of the signals COMA$\alpha$ and VBS$\alpha$ (where $\alpha$=2, 3, 4) and the other end side half (the two levels worth on the bottom side in FIG. 14) is a sequence block of the signals COMB$\alpha$ and VBS$\alpha$.

In this manner, the first wires CW1, the second wires CW2, and the third wires CW3 which propagate the plurality of (for example, two) first drive signals COMA, the plurality of (for example, two) second drive signals COMB, and the plurality of (for example, four) reference voltage signals VBS which drive the common discharge unit group 36 are arranged in block units corresponding to every color in the cable width direction. Therefore, it is possible to electrically connect the first wires CW1 which are connected to a common discharge unit group 36 and the second wires CW2 which connect to a common discharge unit group 36 inside the print head 25, the first wires CW1 and the second wires CW2 being wired at the one end side and the other end side of the wire regions WA of the two flat cables 481 and 482 in the width direction. The drive signals COMA1 to COMA4 and COMB1 to COMB4 are not adjacent to each other in the width direction or the overlapping direction of the cable. According to this configuration, the wires of the drive signals COMA1 to COMA4 and COMB1 to COMB4 are capable of reducing the influence of mutual induction to a small amount and suppressing the overshooting to a small amount in comparison with a configuration in which the drive signals are positioned adjacent to one another in at least one of the width direction and the overlapping direction of the flat cables 481 and 482.

In the cable 45, the distance between the first wires CW1 and the second wires CW2, and the wires for the control signals such as the print data signals SIn, the latch signal LAT, the change signal CH, and the clock signal SCK are relatively separated. Therefore, the control signals do not easily pick up noise from the influence of the high-voltage drive signals COMA1 to COMA4 and COMB1 to COMB4. In the cable 48, all or a portion of the wires CW3 of the reference voltage signals VBS1 to VBS4 may be replaced with wires of the ground signal GND.

Figure 10:
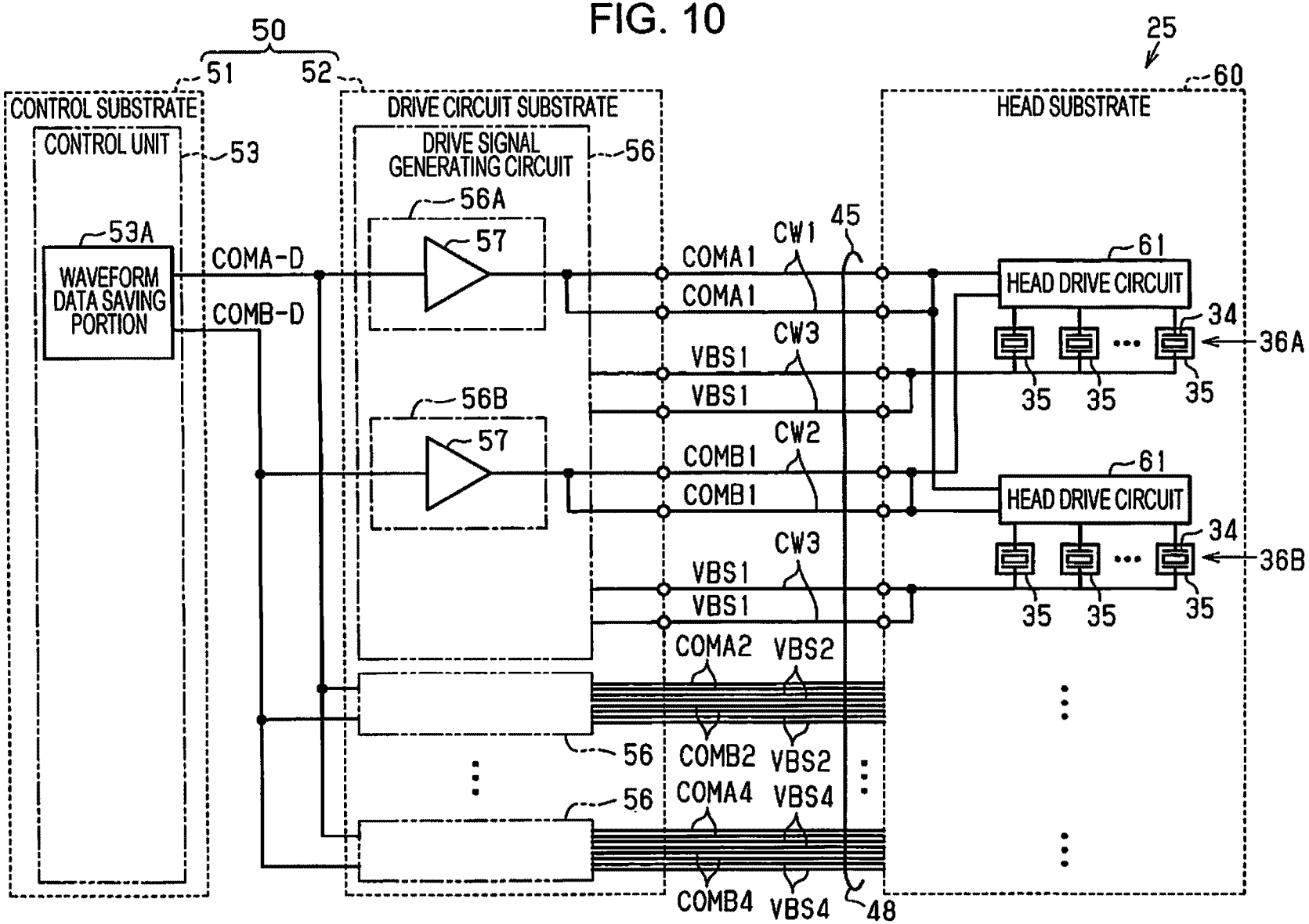
FIG. 10 is a block diagram illustrating a detailed electrical configuration between a control circuit and a head substrate.

Next, a detailed description will be given of the drive signal generating circuit 56 with reference to FIG. 10. As illustrated in FIG. 10, the control unit 53 includes a waveform data saving portion 53A in which the waveform data COMA-D, and COMB-D are saved. The control unit 53 transmits the waveform data COMA-D and COMB-D which is read out from the waveform data saving portion 53A to the drive signal generating circuit 56 based on the print mode information, for example. The drive signal generating circuit 56 generates two of each of the drive signals COMA1 to COMA4 based on the waveform data COMA-D, which is transmitted by the control unit 53, and generates two of each of the drive signals COMB1 to COMB4 based on the waveform data COMB-D, which is transmitted by the control unit 53. The drive signal generating circuit 56 transmits the generated drive signals COMA1 to COMA4 and COMB1 to COMB4 (refer to FIG. 4) to the print head 25 via the long cable 45 (48) which is greater than or equal to 1 m. FIG. 10 illustrates the detailed internal configuration of only the drive signal generating circuit 56 which generates the drive signals COMA1 and COMB1 and the reference voltage signal VBS1. Since the configurations of the drive signal generating circuits 56 are essentially the same, hereinafter, a description will be given of the internal configuration and the operations of the drive signal generating circuit 56 which generates the drive signals COMA1 and COMB1 as an example.

As illustrated in FIG. 10, the drive signal generating circuit 56 is provided with a first signal generating circuit 56A which generates the first drive signal COMA1 based on the waveform data COMA-D from the control unit 53, and a second signal generating circuit 56B which generates the second drive signal COMB1 based on the waveform data COMB-D. The first signal generating circuit 56A is provided with a waveform generating circuit 57 which converts the digital first drive signal which is generated based on the waveform data COMA-D into the analog first drive signal and amplifies the analog first drive signal. The waveform generating circuit 57 is provided with the DAC and the amplifying circuit (both not illustrated) which are described earlier. The first drive signal COMA1 which is output by the waveform generating circuit 57 is divided into two and is propagated to the head substrate 60 inside the print head 25 via the two first wires CW1 which configure the cable 48. The second signal generating circuit 56B is provided with the waveform generating circuit 57 which converts the digital second drive signal which is generated based on the waveform data COMB-D into the analog second drive signal and amplifies the analog second drive signal. The waveform generating circuit 57 is provided with the DAC and the amplifying circuit (both not illustrated) which are described earlier. The second drive signal COMB1 which is output by the waveform generating circuit 57 is divided into two and is propagated to the head substrate 60 inside the print head 25 via the two second wires CW2 which configure the cable 48. The drive signals COMA1 and COMB1, from which high-frequency components are removed by low-pass filters, are output from the waveform generating circuits 57.

Each of the other plurality of (three) drive signal generating circuits 56 illustrated in FIG. 10 are similarly provided with the first signal generating circuit 56A and the second signal generating circuit 56B. Two of each of the first drive signals COMA2 to COMA4 and the second drive signals COMB2 to COMB4 are output from the other three drive signal generating circuits 56 and four each of the reference voltage signals VBS2 to VBS4 are output from the other three drive signal generating circuits 56. The two each of the first drive signals COMA1 to COMA4, the two each of the second drive signals COMB1 to COMB4, and the four each of the reference voltage signals VBS1 to VBS4 are propagated to the print head 25 via the wires CW1 to CW3 which are arranged in the layout illustrated in FIG. 9 inside the cable 48.

As illustrated in FIG. 10, Q (two) head drive circuits 61 which drive a first discharge unit group 36A and a second discharge unit group 36B which discharge droplets (ink droplets) of the same color (the same type of color) are installed on the head substrate 60 inside the print head 25. The first drive signal COMA1 and the second drive signal COMB1 are input to the Q (two) head drive circuits 61 for the first color. One head drive circuit 61 causes droplets to be discharged from the discharge units 35 of the first discharge unit group 36A by driving the drive elements 34 according to the potential differences between the drive signals COMA1 and COMB1 and the reference voltage signal VBS1. The other head drive circuit 61 causes droplets to be discharged from the discharge units 35 of the second discharge unit group 36B by driving the drive elements 34 according to the potential differences between the drive signals COMA1 and COMB1 and the reference voltage signal VBS1.

As illustrated in FIG. 10, the Q (two) head drive circuits 61 which drive the Q (two) discharge unit groups 36A and 36B which are capable of discharging droplets of the same color receive input of the two first drive signals COMA1 and COMA1. The two first wires CW1 and CW1 on which the two first drive signals COMA1 and COMA1 are propagated are electrically connected (conducting) on the head substrate 60 inside the print head 25. Similarly, the Q (two) head drive circuits 61 which drive the Q (two) discharge unit groups 36A and 36B which are capable of discharging droplets of the same color receive input of the two second drive signals COMB1 and COMB1. The two second wires CW2 and CW2 on which the two second drive signals COMB1 and COMB1 are propagated are electrically connected (conducting) on the head substrate 60 inside the print head 25. Although not illustrated, head drive circuits 61 for Q (two) for every color (a total of six head drive circuits 61) capable of driving the first discharge unit groups 36A and the second discharge unit groups 36B which discharge droplets (ink droplets) of the same color are installed on the head substrate 60 for the other colors (the second color and the fourth color). Corresponding to the same color, two each of the first wires CW1 and CW1 over which two each of the first drive signals COMA1 and COMA1, which are input to two each of the head drive circuits 61, are propagated are electrically connected (conducting) in the print head 25. Similarly, corresponding to the same color, two each of the second wires CW2 and CW2 over which two each of the second drive signals COMB1 and COMB1, which are input to two each of the head drive circuits 61, are propagated are electrically connected (conducting) in the print head 25.

The power voltage VHV is set to a value (for example, 42 V) which is less than the rated voltage of the electronic components having the lowest rated voltage (for example, the transfer gates 82*a*, 82*b*, the drive elements 34, and the like) from among the various electronic components to which the drive signals COMA and COMB are applied in the head drive circuit 61. The amplitudes of the drive signals COMA and COMB are set in a range in which the maximum voltage is less than the power voltage VHV, for example, approximately 2 V to 37 V. In the wires CW1 to CW3 which configure the long cable 48 which is greater than or equal to 1 m which can support serial printing greater than or equal to A3 short side width, the inductance increases originating in the length of the cable 48. When the cable 45 moves or like in accordance with the movement or the like of the head unit 23, the amplitude of the inductance increases. For example, there is a case in which overshooting occurs in the drive signals COMA and COMB due to mutual induction or the like originating in the large inductances of the wires CW1 to CW3. When the voltage of the overshooting exceeds the power voltage VHV, for example, an excessive voltage which exceeds the rated voltage of is applied to the transfer gates 82*a* and 82*b*, the drive elements 34, and the like. Therefore, in the present embodiment, in a configuration of a multi-drive type (a multi-common type) which uses two types of the drive signals COMA and COMB, by adopting the wiring layout of the cable 48 illustrated in FIGS. 9 and 14, the overshooting which originates in mutual induction between the drive signals is reduced.

Figures 11, 12:
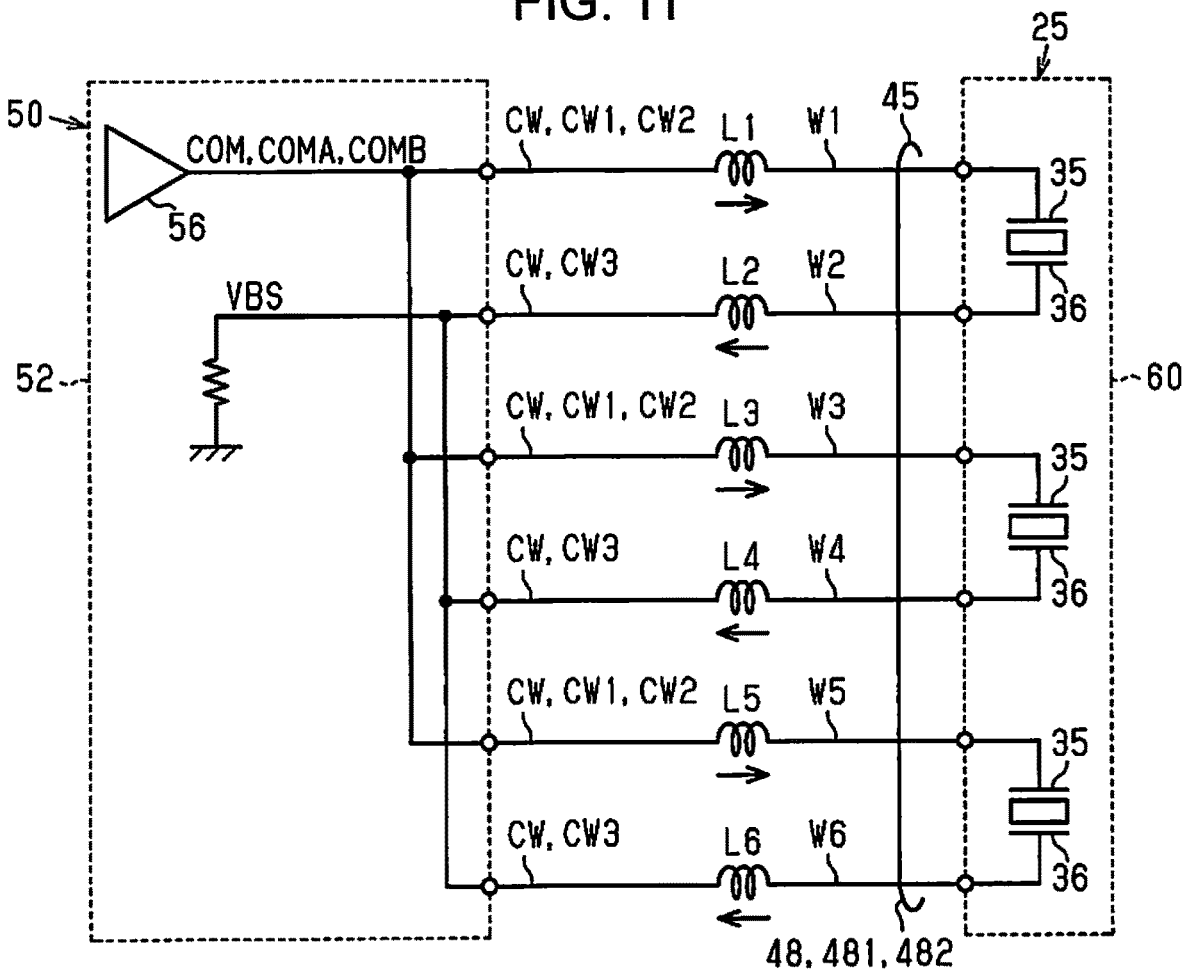
FIG. 11 is an equivalent circuit illustrating inductances which float on wires in the cable which connects the control circuit to the print head.
FIG. 12 is a diagram illustrating a degree of influence of a magnetic field of a mutual induction which is received by each inductor in the equivalent circuit illustrated in FIG. 11 using a table.

FIG. 11 is an equivalent circuit illustrating inductances which float on the wires CW originating in the fact that the plurality of wires CW (core wires) in the cable 45 (48) are long or the like in the large format printer 11 in which the control circuit 50 and the print head 25 are connected by the cable 45. In FIG. 11, the head drive circuits 61 on the head substrate 60 are omitted, and an equivalent circuit is illustrated in a state in which both ends of the discharge units 35 are connected to the two wires CW (CW, CW3), and the drive signals COM (COMA and COMB) are applied to the positive terminals of the discharge units 35. In the equivalent circuit in FIG. 11, floating (parasitic) inductances Ln (where the suffix n is n=1, 2, . . . , 8) are present in the wires CW which are connected to the discharge unit groups 36 corresponding to the nozzle row 32 of the nozzle row number n.

In the example illustrated in FIG. 11, for convenience of description, there are three discharge unit groups 36 and there are six of the wires CW (core wires) in the cable 48 which is connected to both sides of the discharge units 35 which configure the three discharge unit groups 36. The inductances which float on the six wires CW are L1 to L6. The equivalent circuit of FIG. 11 models one of the two flat cables 481 and 482 which configure the cable 48. In the order in which the wires CW are lined up from the first end portion side (topmost in FIG. 11) of the cable 48 in the width direction, the wires CW are numbered W1 to W6 and the inductances which float on the wires W1 to W6 are numbered L1 to L6. Here, the pitch (the distance between the centers of a core wire and the core wire adjacent thereto) of the wires CW in the width direction (the up-down direction in FIG. 11) is set to a unit distance Lp=1. In the flat cables 481 and 482 in which the plurality of wires CW extend in parallel, a degree of influence (hereinafter also referred to as "a degree of influence of a magnetic field caused by mutual induction") representing the strength of a magnetic field caused by the mutual induction on another wire CW in a position which is a distance r from the wire CW is inversely proportionate to the distance r from the wire CW. When a current flows while increasing in the direction of the arrow in FIG. 11, in a case in which there is an effect in which the voltage of the control circuit 50 side becomes higher than the print head 25 side, the degree of influence of the magnetic field caused by the mutual induction is positive (plus), and conversely, in a case in which there is an effect in which the voltage of the control circuit 50 side becomes lower than the print head 25 side, the degree of influence is negative (minus).

For example, the distance r between the wire W2 and the wire W5 is depicted by r=5Lp−2Lp and when the unit distance Lp=1 is set, r=3. The strength of the magnetic field caused by the mutual induction on the wire W5 which is at a position the distance r from the wire W2 is inversely proportional to the distance r. Therefore, when an inverse proportionality constant is "1", the strength of the magnetic field that is applied to the wire W5 by the wire W2 can be considered 1/r. In this case, since the distance r 3, the influence of the strength of the magnetic field which is applied to the wire W5 by the wire W2 is 0.33 of 1/r.

In the wires which are lined up in parallel, those in which the current flows in the same direction work to increase the inductance. Therefore, the wires which have odd numbers strengthen the influence of the strengths of the magnetic fields of each other. The self-inductance of the wires W1, W3, and W5 which have odd numbers is positive (plus). Accordingly, the self-inductance of the wires W1, W3, and W5 which have odd numbers is strengthened by the magnetic fields from the other wires which have odd numbers. Therefore, the influence that the strength of the magnetic fields from the wires W1, W3, and W5 which have odd numbers applies to the other wires which have odd numbers is positive (plus). Meanwhile, the wires W2, W4, and W6 which have even numbers strengthen the influence of the strengths of the magnetic fields of each other. The self-inductance of the wires W2, W4, and W6 which have even numbers is negative (minus). Accordingly, the self-inductance of the wires W2, W4, and W6 which have even numbers is strengthened by the magnetic fields from the other wires which have even numbers. Therefore, the influence that the strength of the magnetic fields from the wires W2, W4, and W6 which have even numbers applies to the other wires which have even numbers is negative (minus). Here, the value of 1/r in consideration of the polarity is set to the degree of influence of the magnetic field which is caused by the mutual induction.

The table illustrated in FIG. 12 illustrates the degrees of influence of the magnetic fields received by the inductors L1 to L6 on the equivalent circuit which has the inductances which float on the wires W1 to W6 inside the flat cables 481 and 482 in the equivalent circuit illustrated in FIG. 11 from the individual other wires (the inductors L1 to L6), and the totals of the degrees of influence of the individual magnetic fields. FIG. 12 is a table illustrating, with positive or negative signs attached, the degrees of influence of the magnetic fields received by the inductors L1 to L6 of the first row from the inductors L1 to L6 of the leftmost column due to self-inductance or mutual induction.

The calculation method of the values in the table illustrated in FIG. 12 is described hereinafter. For example, the first column, second row of the table indicates that the influence applied to the inductor L1 by the inductor L2 is "−1". The positive "+" of the first column, first row indicates that this is self-inductance and is a positive value greater than "1" (for example, greater than or equal to 2). For example, since the influence applied to the inductor L1 by the inductor L2 has a different sign which is negative "−", the overshooting is reduced. In the table of FIG. 12, when all of the degrees of influence of the magnetic fields which are received by the inductor L1 from the inductors L2 to L6 of the other rows are added together, a total of "−0.78" is obtained. This is added to the positive self-inductance (>1). Therefore, with regard to L1, L3, and L5, the greater the negative absolute value of the total, the more is contributed to the reduction of the overshooting. For example, the values of the totals of L1, L3, and L5 are compared, the negative absolute value of L1 is the smallest, the degree of influence of the magnetic field caused by the mutual induction of the wire W1 (CW1 and CW2) which is positioned at an end of the wire region WA of the cable 48 is the greatest, and the overshooting which originates in the mutual induction is greatest. The negative absolute value of L5 is the largest, the degree of influence of the magnetic field caused by the mutual induction of the wire W5 (CW1 and CW2) which is second from the end of the cable 48 is the greatest, and the overshooting which originates in the mutual induction is smallest.

In other words, in the wire region WA of the cable 48, the degree of influence of the magnetic field caused by mutual induction of the wire W1 (CW1, CW2) which is positioned at the end without being interposed by the wires CW3 is the greatest. In the wire region WA, the degree of influence of the magnetic field caused by mutual induction of the wire W5 (CW1, CW2) which is positioned second from the end in a state of being interposed by the wires CW3 on both sides is the smallest.

FIG. 13 illustrates the signals which are propagated on the arrangement of the wires (core wires) in the cable of a comparative example. In the comparative example illustrated in FIG. 13, the first drive signals COMA1 to COMA4 and the reference voltage signals VBS1 to VBS4 are arranged alternately in the first flat cable 481 in the cable width direction (the up-down direction in FIG. 13). In other words, the wire region WA of the first flat cable 481 has a wiring layout in which the signals are propagated in the order of COMA1, VBS1, COMA1, VBS1, COMA2, VBS2, . . . , COMA4, VBS4.

The first drive signals COMA1 to COMA4 and the reference voltage signals VBS1 to VBS4 are arranged alternately in the second flat cable 482 in the cable width direction (the up-down direction in FIG. 13). In other words, the wire region WA of the second flat cable 482 has a wiring layout in which the signals are propagated in the order of VBS1, COMB1, VBS1, COMB1, VBS2, COMB2, . . . , VBS4, COMB4. The first flat cable 481 and the second flat cable 482 overlap each other in a state in which the wires of the first drive signals COMA face the wires of the reference voltage signals VBS and the wires of the second drive signals COMB face the wires of the reference voltage signal VBS.

In the wiring layout in the comparative example illustrated in FIG. 13, the degree of influence of the magnetic field originating in the mutual induction becomes a larger maximum in the drive signals COMA1 than the other drive signals COMA2 to COMA4 and becomes a larger maximum in the drive signals COMB4 than the other drive signals COMB1 to COMB3. In the configuration of the comparative example, a countermeasure is necessary to reduce the amplitudes of the drive signals COMA and COMB such that the overshooting does not exceed the rated voltage of the transfer gate (TG) and cause voltage breakdown. When such a countermeasure is carried out, it is difficult to obtain sufficient liquid discharging characteristics.

Meanwhile, the first drive signals COMA1 to COMA4 and the second drive signals COMB1 to COMB4 are arranged alternately in the first flat cable 481 in the example illustrated in FIG. 14 in the cable width direction (the up-down direction in FIG. 14) and the reference voltage signals VBS1 to VBS4 are interposed between the first and second drive signals. In other words, the wire region WA of the first flat cable 481 has a wiring layout in which the signals are propagated in the order of COMA1, VBS1, COMB1, VBS1, COMA2, VBS2, COMB2, . . . , COMA4, VBS4, COMB4, VBS4.

Similarly, the first drive signals COMA1 to COMA4 and the second drive signals COMB1 to COMB4 are arranged alternately in the second flat cable 482 in the cable width direction (the up-down direction in FIG. 14) and the reference voltage signals VBS1 to VBS4 are interposed between the first and second drive signals. In other words, the wire region WA of the second flat cable 482 has a wiring layout in which the signals are propagated in the order of VBS1, COMA1, VBS1, COMB1, VBS2, COMA2, VBS2, COMB2, . . . , VBS4, COMA4, VBS4, COMB4. The first flat cable 481 and the second flat cable 482 overlap each other in a state in which the wires of the first drive signals COMA face the wires of the reference voltage signals VBS and the wires of the second drive signals COMB face the wires of the reference voltage signal VBS.

In the wiring layout in the example illustrated in FIG. 14, the degree of influence of the magnetic field originating in the mutual induction of the drive signals COMA1 becomes a larger maximum in the first flat cable 481 than the other drive signals COMA2 to COMA4. The degree of influence of the magnetic field originating in the mutual induction of the drive signals COMA1 becomes a smaller minimum in the second flat cable 482 than the other drive signals COMA2 to COMA4. The degree of influence of the magnetic field originating in the mutual induction of the drive signal COMB4 becomes a smaller minimum in the first flat cable 481 than the other drive signals COMB1 to COMB3, and the degree of influence of the magnetic field originating in the mutual induction of the second drive signal COMB4 becomes a larger maximum in the second flat cable 482 than the other drive signals COMB1 to COMB3.

In the configuration of the example, the wire of the first drive signal COMA1 in which the degree of influence of the magnetic field is the maximum in the first flat cable 481 and the wire of the first drive signal COMA1 in which the degree of influence of the magnetic field is the minimum in the second flat cable 482 are electrically connected (conducting) inside the print head 25. Therefore, the maximum value and the minimum value of the degree of influence of the magnetic field is averaged between the two first drive signals COMA1 and the maximum value of the degree of influence of the magnetic field in the first drive signals COMA1 to COMA4 is suppressed to a small value.

The wire CW2 of the second drive signal COMB4 in which the degree of influence of the magnetic field is the minimum in the first flat cable 481 and the wire CW2 of the second drive signal COMB4 in which the degree of influence of the magnetic field in the second flat cable 482 is the maximum are electrically connected (conducting) in the print head 25. Therefore, the maximum value and the minimum value of the degree of influence of the magnetic field is averaged between the two second drive signals COMB4 and the maximum value of the degree of influence of the magnetic field in the second drive signals COMB1 to COMB4 is suppressed to a small value. Therefore, in comparison with the comparative example, it becomes possible to set the amplitudes of the drive signals COMA and COMB relatively high and it is easy to obtain sufficient liquid discharging characteristics.

Next, a description will be given of the operations of the large format printer 11. When the large format printer 11 receives print data from a host computer, for example, the large format printer 11 starts the printing control.

The control unit 53 illustrated in FIG. 10 reads the waveform data COMA-D and COMB-D which correspond to the print mode information included in the print data from the waveform data saving portion 53A and transmits the waveform data COMA-D and COMB-D to the drive signal generating circuits 56. In the drive signal generating circuits 56, the first drive signals COMA1 to COMA4 are generated based on the waveform data COMA-D and the second drive signals COMB1 to COMB4 are generated based on the waveform data COMB-D. The first drive signals COMA1 to COMA4 which are generated are propagated from the control circuit 50 (the drive circuit substrate 52) to the head substrate 60 inside the print head 25 via the first wires CW1 inside the cable 45 (48) illustrated in FIG. 9. The second drive signals COMB1 to COMB4 which are generated are propagated from the control circuit 50 (the drive circuit substrate 52) to the head substrate 60 inside the print head 25 via the second wires CW2 inside the cable 45 (48) illustrated in FIG. 9. The reference voltage signals VBS1 to VBS4 which are generated by the drive signal generating circuit 56 are propagated to the head substrate 60 inside the print head 25 via the third wires CW3 inside the cable 45 (48) illustrated in FIG. 9.

The first drive signals COMA1 to COMA4, the second drive signals COMB1 to COMB4, and the reference voltage signals VBS1 to VBS4 are propagated from the control circuit 50 (the drive signal generating circuit 56) to the print head 25 via the wires CW1 to CW3 inside the cable 45 (48) illustrated in FIG. 9 which is greater than or equal to 1 m.

As illustrated in FIG. 4, the print data signals SI1 to SI8, the latch signal LAT, the change signal CH, the clock signal SCK, and the like are propagated via the control signal transmission unit 54 from the control unit 53 to the head substrate 60 inside the print head 25 via the wires in the cable 47. In the head drive circuit 61, the selection signals Sa and Sb (refer to FIGS. 6 and 8) are generated based on the signals SI1 to SI8, LAT, CH, and SCK which are input and are transmitted to the selection unit 80 (illustrated in FIG. 8) inside the switch circuit 67. The selection unit 80 selects the waveforms in the first drive signal COMA and the second drive signal COMB for every duration T1 and T2 according to the values of the selection signals Sa and Sb which are input and applies the drive signal VOUT (FIG. 7) of the selected result to the discharge unit 35. The drive element 34 of the discharge unit 35 is driven according to the voltage difference between the drive signal VOUT which is applied to one terminal and the reference voltage signal VBS which is applied to the other terminal and the discharge unit 35 discharges the liquid from the nozzle 31. In this manner, an image which is based on the print data is printed on the medium M due to the liquid being discharged according to the print data from the discharge units 35 which configure the discharge unit groups 36, Q (two) of which are provided for each of the colors.

In the present embodiment, the first drive signals COMA1 to COMA4, the second drive signals COMB1 to COMB4, and the reference voltage signals VBS1 to VBS4, which are generated by the control circuit 50, are propagated via the wires CW1 to CW3 inside the cable 48 illustrated in FIG. 9 which is greater than or equal to 1 m. At this time, as illustrated in FIG. 9, the first drive signals COMA1 to COMA4 and the second drive signals COMB1 to COMB4 are propagated on the first wires CW1 and the second wires CW2 which are disposed staggered by one in the width direction in the wire regions WA of the two flat cables 481 and 482. The reference voltage signals VBS1 to VBS4 are propagated via the third wires CW3 which are positioned between the wires CW1 and CW2 in the width direction in the wire regions WA (or alternatively, the third wires CW3 which interpose the first wires CW1 or the second wires CW2 in the width direction) of the two flat cables 481 and 482.

As illustrated in FIG. 9, it is possible to separate the wires CW1 and CW2 of the drive signals COMA1 to COMA4 and COMB1 to COMB4 by a comparatively long distance corresponding to double the pitch of the wiring pitch in the cable width direction. Therefore, the degrees of influence of the magnetic fields caused by the mutual induction between the drive signals COMA1 to COMA4 and COMB1 to COMB4 are reduced and a reduction in overshooting may be obtained. The first wires CW1 and the second wires CW2 face the third wires CW3 of the flat cables of the partner side in the overlapping direction of the two flat cables 481 and 482. Therefore, in comparison to a configuration in which the first wires CW1 and the second wires CW2 do not face the third wires in the cable overlapping direction, it is possible to reduce the overshooting which originates in the mutual induction between the drive signals COMA1 to COMA4 and COMB1 to COMB4.

Even in the cable wiring structure of the comparative example illustrated in FIG. 13, the wires on which the reference voltage signals VBS1 to VBS4 are propagated are disposed between the wires on which the first drive signals COMA1 to COMA4 are propagated and the wires on which the second drive signals COMB1 to COMB4 are propagated. In the cable wiring structure of the comparative example, the first wires CW1 on which the first drive signals COMA1 to COMA4 are propagated and the second wires CW2 on which the second drive signals COMB1 to COMB4 are propagated face the third wires CW3 on which the reference voltage signals VBS1 to VBS4 of the flat cable of the partner side are propagated, where the first wires CW1 face the second wires CW2 in the overlapping direction of the two flat cables 481 and 482. Therefore, even in the cable wiring structure of the comparative example, a fixed effect may be obtained in reducing the overshooting.

In the comparative example illustrated in FIG. 13, the degree of influence of the magnetic field caused by the mutual induction which is received by the first drive signal COMA1 of one end side (the first row from the top in FIG. 13) of the first flat cable 481 is maximum, and similarly, the degree of influence of the magnetic field caused by the mutual induction in the second drive signal COMB4 of the other end side (the first row from the bottom in FIG. 13) of the second flat cable 482 is maximum. Therefore, even if the overshooting occurs in the drive signal in which the degree of influence of the magnetic field caused by the mutual induction is maximum, it is necessary to set the amplitude of the drive signal to a small value such that the maximum voltage originating in the overshooting does not exceed the rated voltage. In this case, for example, discharging faults occur, which leads to a reduction in the print quality, due to the amplitude of the drive voltage being suppressed to a small value.

Meanwhile, in the example illustrated in FIG. 14, the degree of influence of the magnetic field caused by the mutual induction which is received by the first drive signal COMA1 of one end side (the first row from the top in FIG. 14) in the wire region WA of the first flat cable 481 is maximum, and the degree of influence of the magnetic field caused by the mutual induction which is received by the second drive signal COMB4 of the second row from the other end side (the second row from the bottom in FIG. 14) is minimum. Similarly, the degree of influence of the magnetic field caused by the mutual induction which is received by the first drive signal COMA1 of the second from one end (the second row from the top in FIG. 14) in the wire region WA of the second flat cable 482 is minimum, and the degree of influence of the magnetic field caused by the mutual induction which is received by the second drive signal COMB4 of the other end side (the first row from the bottom in FIG. 14) is maximum.

In the example illustrated in FIGS. 9 and 14, the first wire CW1 of the first drive signal COMA1 in which the degree of influence of the magnetic field caused by the mutual induction is the maximum in the first flat cable 481 and the first wire CW1 of the first drive signal COMA1 in which the degree of influence of the magnetic field caused by the mutual induction is the minimum in the second flat cable 482 are electrically connected (conducting) inside the print head 25. As a result, the maximum value of the degree of influence of the magnetic field received by the first drive signal COMA1 due to the mutual induction in the first flat cable 481 and the minimum value of the degree of influence of the magnetic field received by the first drive signal COMA1 due to the mutual induction in the second flat cable 482 are averaged. Accordingly, it is possible to suppress the maximum values of the degrees of influence of the magnetic fields received by the first drive signals COMA1 to COMA4 due to the mutual induction to small values.

In the example illustrated in FIGS. 9 and 14, the second wire CW2 of the second drive signal COMB4 in which the degree of influence of the magnetic field caused by the mutual induction is the minimum in the first flat cable 481 and the second wire CW2 of the second drive signal COMB4 in which the degree of influence of the magnetic field caused by the mutual induction is the maximum in the second flat cable 482 are electrically connected inside the print head 25. As a result, the minimum value of the degree of influence of the magnetic field received by the second drive signal COMB4 due to the mutual induction in the first flat cable 481 and the maximum value of the degree of influence of the magnetic field received by the second drive signal COMB4 due to the mutual induction in the second flat cable 482 are averaged. Accordingly, it is possible to suppress the maximum values of the degrees of influence of the magnetic fields received by the second drive signals COMB1 to COMB4 due to the mutual induction to small values.

Therefore, according to the cable 48 of the example illustrated in FIGS. 9 and 14, it is possible to suppress the maximum values of the degrees of influence of the magnetic fields caused by the mutual induction to relatively small values in comparison to the comparative example illustrated in FIG. 13. Accordingly, it is possible to relatively reduce the overshooting which occurs in the drive signals to a small level. As a result, it is not necessary to set the amplitude of the drive signal to as small a value as in the comparative example in order to ensure that the maximum voltage originating in the overshooting comes within less than or equal to the rated voltage. Therefore, in the example, it is possible to set the amplitude of the drive signal to a relatively large value in comparison to the comparative example. As a result, discharging faults do not occur easily and it is possible to perform the printing at a comparatively high print quality using the large format printer 11.

Even if the overshooting hypothetically occurs, the maximum voltage of the drive signals COMA and COMB which are input to the head drive circuit 61 is within less than or equal to the power voltage VHV and is prevented from exceeding the rated voltage. Accordingly, a voltage which exceeds the rated voltage is not applied to the transfer gates 82*a* and 82*b* and the drive elements 34. As a result, it is possible to protect the transfer gates 82*a* and 82*b*, the drive elements 34, and the like from damage originating in this type of overshooting and originating in a voltage exceeding the rated voltage being applied. For example, it is possible to stably drive the print head 25 over a long period. Accordingly, it is possible to effectively reduce the overshooting which occurs in the drive signals COMA and COMB originating in an increase in the length of the cable 45 (48) and the mutual induction or the like between the first drive signals COMA and the second drive signals COMB, and it is possible to reduce at least one of the problems of damage to the print head 25, disruption to print quality, and the like in the drive signals COMA1 and COMA2.

According to the embodiment which is described in detail above, it is possible to obtain the following effects.

(1) The large format printer 11 capable of serial printing on the medium M which is greater than or equal to A3 short side width is provided with the control circuit 50 and the print head 25. The control circuit 50 is provided with the drive signal generating circuits 56 which output the first drive signals COMA which include the first waveforms, the second drive signals COMB which include the second waveforms, and the reference voltage signals VBS, and the print head 25 includes the plurality of drive elements 34 which are driven and print according to the voltages that are applied. The cable 45 which connects the control circuit 50 and the print head 25 includes the first flat cable 481 and the second flat cable 482 in an overlapping state, where each of the flat cables includes the first wires CW1 which propagate the first drive signals COMA, the second wires CW2 which propagate the second drive signals COMB, and the third wires CW3 which propagate the reference voltage signals VBS1 to VBS4. The first flat cable 481 and the second flat cable 482 are in a state in which the first wires CW1 are adjacent to the third wires CW3, the second wires CW2 are adjacent to the third wires CW3, and in the overlapping direction, the first wires CW1 face the third wires CW3, and the second wires CW2 face the third wires CW3. Accordingly, in comparison to the configuration of the comparative example (FIG. 13) in which the first drive signals COMA and the second drive signals COMB are split and separately propagated on the first flat cable 481 and the second flat cable 482, it is possible to effectively reduce the overshooting originating in the mutual induction between the drive signals.

(2) The first wires CW1 of the first flat cable 481 and the first wires CW1 of the second flat cable 482 are electrically connected in the print head 25. The second wires CW2 of the first flat cable 481 and the second wires CW2 of the second flat cable 482 are electrically connected in the print head 25. Therefore, it is possible to average and moderate the degree of influence caused by the mutual induction between the drive signals in the first flat cable 481 and the degree of influence caused by the mutual induction between the drive signals in the second flat cable 482. Accordingly, it is possible to more effectively reduce the overshooting originating in the mutual induction of the drive signals.

(3) The print head 25 is provided with the discharge unit group 36 (an example of the drive element group) which includes the plurality of drive elements 34 which are driven in order to print the same type of color. The two flat cables 481 and 482 are provided with the plurality of first wires CW1 which propagate the first drive signals COMA and the plurality of second wires CW2 which propagate the second drive signals COMB for each of the plurality of discharge unit groups 36 which print the same type of color. Of the plurality of first wires CW1 in the first flat cable 481, the first wire CW1 which is positioned at an endmost portion and, of the plurality of first wires CW1 in the second flat cable 482, the first wire CW1 which is positioned next to the third wire CW3 which is positioned at an endmost portion are electrically connected in the print head 25. Of the plurality of second wires CW2 in the first flat cable 481, the second wire CW2 which is positioned next to the third wire CW3 which is positioned at an endmost portion and, of the plurality of second wires CW2 in the second flat cable 482, the second wire CW2 which is positioned at an endmost portion are electrically connected in the print head 25. Therefore, it is possible to average the maximum value of the degree of influence of the magnetic field caused by the mutual induction between the drive signals in one of the two flat cables 481 and 482 and the minimum value of the degree of influence of the magnetic field caused by the mutual induction between the drive signals in the other of the two flat cables 481 and 482. Accordingly, it is possible to more effectively reduce the overshooting originating in the mutual induction of the drive signals.

(4) The first wires CW1, the second wires CW2, and the third wires CW3 which propagate the plurality of (for example, two) first drive signals COMA, the plurality of (for example, two) second drive signals COMB, and the plurality of (for example, four) reference voltage signals VBS which drive the common discharge unit group 36 are arranged in block units corresponding to every color in the cable width direction in the two flat cables 481 and 482. Accordingly, it is possible to electrically connect the first wires CW1 which are connected to a common discharge unit group 36 and the second wires CW2 which connect to a common discharge unit group 36 inside the print head 25, the first wires CW1 and the second wires CW2 being wired at the one end side and the other end side of the wire regions WA of the two flat cables 481 and 482 in the width direction. Therefore, it is possible to average the maximum value and the minimum value of the degrees of influence of the magnetic fields caused by the mutual induction between the drive signals and to more effectively reduce the overshooting originating in the mutual induction.

(5) The plurality of discharge unit groups 36 (examples of the drive element groups) which print different colors are provided. The number of the discharge unit groups 36 that print the same type of color which are provided is Q (where Q is a natural number greater than or equal to 2). Q of the first wires CW1 which propagate the first drive signals COMA which are supplied to Q of the discharge unit groups 36, respectively, are electrically connected to each other in the print head 25. Q of the second wires CW2 which propagate the second drive signals COMB which are supplied to Q of the discharge unit groups 36, respectively, are electrically connected to each other in the print head 25. Accordingly, the maximum value and the minimum value of the degrees of influence of the magnetic fields caused by the mutual induction is averaged between Q of the first wires CW1 and the maximum value and the minimum value of the degrees of influence of the magnetic fields caused by the mutual induction is averaged between Q of the second wires CW2. Therefore, it is possible to more effectively reduce the overshooting which occurs in the first drive signals COMA and the second drive signals COMB.

(6) In the large format printer 11, the maximum width over with the serial printing is possible is 24 inches to 75 inches. Accordingly, even if the cable 45 is long to the extent that the serial printing is possible at a maximum width of 24 inches to 75 inches, it is possible to more effectively suppress the occurrence of the overshooting in the process of the drive signals COMA and COMB being propagated on the cable 45.

(7) In the large format printer 11, the maximum width over which the serial printing is possible corresponds to one of 24 inches, 36 inches, 44 inches, and 64 inches. Accordingly, even if the cable 45 is a comparatively long cable which supports the serial printing of any one of 24 inches, 36 inches, 44 inches, and 64 inches, it is possible to effectively suppress the occurrence of the overshooting in the drive signals COMA and COMB in the process of the drive signals COMA and COMB being propagated on the cable 45.

(8) The print head 25 discharges the liquid at a frequency greater than or equal to 30 kHz. The drive signals COMA (COMA1 to COMA8) and COMB (COMB1 to COMB8) which are propagated on the cable 45 to drive the print head 25 are high-frequency signals of a still greater value than 30 kHz. Therefore, it is possible to effectively remove the overshooting which occurs easily in the process of the drive signals COMA and COMB being propagated on the cable 45.

The embodiment may also be modified to the forms described below.

The first wires of the first cable and the first wires of the second cable may be electrically connected in the print head 25 or the second wires of the first cable and the second wires of the second cable may be electrically connected in the print head 25.

Of the plurality of first wires CW1 in the first cable, the first wire CW1 which is positioned at an endmost portion and, of the plurality of first wires CW1 in the second cable, the first wire CW1 which is positioned next to the third wire CW3 which is positioned at an endmost portion may simply be electrically connected in the print head 25. Of the plurality of second wires CW2 in the first cable, the second wire CW2 which is positioned at an endmost portion and, of the plurality of second wires CW2 in the second cable, the second wire CW2 which is positioned next to the third wire CW3 which is positioned at an endmost portion may simply be electrically connected in the print head 25.

In the wire regions WA of the two flat cables 481 and 482, for one of the two drive signals COMAα in a sequence block sufficient for four wires of one end side in the cable width direction and the two drive signals COMBα in a sequence block sufficient for four wires of the other end side, it is sufficient for the wires CW for signal propagation to be electrically connected to one another in the print head 25. For example, for only the greater waveform amplitude of the first drive signal COMA and the second drive signal COMB, the wires for signal propagation may be electrically connected inside the print head 25. For at least one of the two first drive signals COMA of the same color type and the two second drive signals COMB of the same color type, as long as the wires for signal propagation are electrically connected, the color type allocated to each sequence block may be changed as appropriate.

It is sufficient for the two first wires CW1 on which the same first drive signals COMA are propagated or the two second wires CW2 on which the same second drive signals COMB are propagated to be electrically connected in the print head 25 at one end portion among both end portions of the wire regions WA in the width direction in the two flat cables 481 and 482. If the two first wires CW1 on which the same first drive signals COMA are propagated or the two second wires CW2 on which the same second drive signals COMB are propagated are electrically connected at the end portions of the wire regions WA, it is possible to average the maximum value and the minimum value of the degrees of influence of the magnetic fields caused by the mutual induction and to moderate the degree of influence to a small level. For example, a configuration may be adopted in which two wires propagating one of the drive signals having the larger amplitudes among the first waveform and the second waveform of each of the first drive signal COMA and the second drive signal COMB are electrically connected in the print head.

In the embodiment, although a plurality of (for example, two) nozzle rows 32 are provided for a single color, the print head 25 may be configured to be provided with a single nozzle row 32 for a single color. In this case, the signals COMAα, COMBα, and VBSα (where α=1, 2, . . . , k) in FIGS. 9 and 14 may be used in the drive control of the single discharge unit group 36 corresponding to the single nozzle row 32. A configuration may be adopted in which the single nozzle row 32 is driven by the plurality of discharge unit groups 36 and the signals COMAα, COMBα, and VBSα are used in the drive control of the plurality of discharge unit groups 36 having a common nozzle row 32. Even in these configurations, each of the wires CW1 which are transmission paths of the signals which are supplied (applied) to each of the plurality of discharge unit groups 36 which are used in the printing of the same color (or the same nozzle row) may be electrically connected (conducting) in the print head 25.

Although in the embodiment the wire regions WA in the two flat cables 481 and 482 are shifted an amount of a single wire in the cable width direction, the wire regions WA may be shifted an amount of three wires or an amount of five wires.

The cable which connects the control circuit 50 to the print head 25 is not limited to a configuration of being formed from a plurality of flexible cables which are disposed overlapping, and a configuration may be adopted in which a first flat cable and a second flat cable are formed integrally in an overlapping state. At least one of a first cable and a second cable may be configured by disposing a plurality of flat cables to line up in the cable width direction.

The cable is not limited to the flexible flat cable and may be a flexible cable. For example, the cable may be a coaxial multi-core cable. In this case, the cable includes a first cable portion formed from a concentric circular first layer (a first cylindrical layer) and a second cable portion formed from a second layer (a second cylindrical layer). Each of the first cable portion and the second cable portion which configure the cable includes first wires which propagate the first drive signals, second wires which propagate the second drive signals, and third wires which propagate the reference voltage signals. Each of the two cable portions has a wiring structure in which the first wires are adjacent to the third wires and the second wires are adjacent to the third wires, and the two cable portions may overlap in a state in which the first wires face the third wires and the second wires face the third wires in the overlapping direction (a radial direction). Even with such a coaxial multi-core cable, it is possible to effectively reduce the overshooting originating in the mutual induction between the drive signals in the same manner as in the embodiment.

A transfer type which uses differential signals may be used as the transfer type of the first drive signals and the second drive signals.

The medium M is not limited to a long medium which is fed out from the roll body 16 and may be a sheet type medium such as single sheet paper having a width greater than or equal to A3 short side width.

The control circuit 50 may be realized through the cooperation of software of a computer which executes a program and hardware of an electronic circuit such as an application specific IC (ASIC), may be realized by only software, and further, may be realized by only hardware.

The large format printer may be a textile printing apparatus, for example, as long as the large format printer is a serial scan type ink jet printer which discharges a liquid in accordance with variation in a drive signal which is applied to a drive element. The large format printer, which is not limited to the ink jet printer, may be a printer including a print head which prints in accordance with variations in a drive signal applied to a drive element, and, for example, may be a dot impact printer and may be a heat transfer type printer.

The large format printer is not limited to a printing apparatus which discharges an ink onto a medium such as paper or film to print an image, and may be an industrial large format printer which uses printing technology (ink jet technology) and is used in the manufacturing of electronic components. For example, an industrial large format printer which discharges a liquid other than ink (including a liquid, a liquid-state body in which particles of a functional material are dispersed or mixed in a liquid, and a fluid-state body such as a gel). For example, a liquid discharging apparatus which discharges a liquid body which contains a material such as an electrode material or a color material (pixel material) in the form of a dispersion or a solution may be used as this type of industrial large format printer. The electrode material or the color material may be used in the manufacture or the like of liquid crystal displays, electroluminescence (EL) displays, and surface emission displays. The industrial large format printer may also be a liquid discharging apparatus which discharges biological organic matter used in the manufacture of bio-chips or a liquid discharging apparatus which is used as a precision pipette to eject a liquid which serves as a sample. A liquid discharging apparatus which discharges lubricant at pinpoint precision into precision machines such as clocks and cameras, a liquid discharging apparatus which discharges a transparent resin liquid such as ultraviolet curing resin onto a substrate in order to form minute semispherical lenses (optical lenses) and the like used in optical communication elements and the like, or a liquid discharging apparatus which discharges an acidic, alkaline, or the like etching liquid for etching a substrate or the like, may also be used as the industrial large format printing apparatus. The large format printer may be a three-dimensional ink jet printer (liquid discharging apparatus) which discharges a liquid such as a resin liquid to manufacture three-dimensional structures.

Examples of the large format printer which perform the serial printing are not limited to a serial scanning type and include a lateral scanning type in which the print head (the carriage) is capable of movement in the two directions of the main scanning direction X and the sub-scanning direction Y. In summary, it is sufficient for the large format printer to be configured such that the print head and the control circuit are connected to each other by a cable in order for it to be possible for the print head to move in the main scanning direction and perform printing and to enable the movement of the print head in the main scanning direction.

What is claimed is:

1. A large format printer capable of serial printing on a medium which is greater than or equal to A3 short side width, comprising:

a control circuit which is provided with a drive signal generating circuit which outputs a first drive signal including a first waveform, a second drive signal including a second waveform, and a reference voltage signal;

a print head which includes a plurality of drive elements which perform printing according to applied voltages; and a cable which connects the control circuit to the print head, wherein the print head includes a head drive circuit which applies voltages corresponding to waveforms which are selected from the first waveform in the first drive signal and the second waveform in the second drive signal which are input via the cable, to the drive elements, wherein the cable includes, in an overlapping state, a first cable and a second cable which each include a first wire which propagates the first drive signal, a second wire which propagates the second drive signal, and a third wire which propagates the reference voltage signal, and wherein in the first cable and the second cable, the first wire is adjacent to the third wire, the second wire is adjacent to the third wire, and, in an overlapping direction, the first wire overlaps the third wire, and the second wire overlaps the third wire.

2. The large format printer according to claim 1, wherein the first wire of the first cable and the first wire of the second cable are electrically connected to each other in the print head, or the second wire of the first cable and the second wire of the second cable are electrically connected to each other in the print head.

3. The large format printer according to claim 1, wherein the print head includes one or a plurality of drive element groups each including a plurality of drive elements which are driven to print a same type of color, wherein the first cable and the second cable each include a plurality of the first wires which propagate the first drive signals and a plurality of the second wires which propagate the second drive signals, to each of the drive element groups which prints the same type of color, wherein, of the plurality of first wires in the first cable, the first wire which is positioned at an endmost portion in a wire arrangement direction and, of the plurality of first wires in the second cable, the first wire which is positioned next to the third wire which is positioned at an endmost portion in the wire arrangement direction are electrically connected in the print head, or of the plurality of second wires in the first cable, the second wire which is positioned next to the third wire which is positioned at an endmost portion in the wire arrangement direction and, of the plurality of second wires in the second cable, the second wire which is positioned at an endmost portion in the wire arrangement direction are electrically connected to each other in the print head.

4. The large format printer according to claim 3, further comprising:

a plurality of drive element groups which print different colors, wherein Q (where Q is a natural number greater than or equal to 2) of the drive element groups which print a same type of color are provided, wherein Q of the first wires which propagate the first drive signals which are supplied to Q of the drive element groups, respectively, are electrically connected to each other in the print head, and wherein Q of the second wires which propagate the second drive signals which are supplied to Q of the drive element groups, respectively, are electrically connected to each other in the print head.

5. The large format printer according to claim 1, wherein a maximum width over which the serial printing is possible is 24 inches to 75 inches.

6. The large format printer according to claim 5, wherein the maximum width over which the serial printing is possible is any one of 24 inches, 36 inches, 44 inches, and 64 inches.

7. The large format printer according to claim 1, wherein the print head discharges a liquid at a frequency greater than or equal to 30 kHz to perform printing.

8. The large format printer according to claim 1, wherein the third wire is interposed between the first wire and the second wire.

9. A large format printer capable of serial printing on a medium which is greater than or equal to A3 short side width, comprising:

a control circuit which is provided with a drive signal generating circuit which outputs a first drive signal including a first waveform, a second drive signal including a second waveform, and a reference voltage signal;

a print head which includes a plurality of drive elements which perform printing according to applied voltages; and a cable which connects the control circuit to the print head, wherein the print head includes a head drive circuit which applies voltages corresponding to waveforms which are selected from the first waveform in the first drive signal and the second waveform in the second drive signal which are input via the cable, to the drive elements, wherein the cable includes, in an overlapping state, a first cable and a second cable which each include a first wire which propagates the first drive signal, a second wire which propagates the second drive signal, and a third wire which propagates the reference voltage signal, wherein in the first cable and the second cable, the first wire is adjacent to the third wire, the second wire is adjacent to the third wire, and, in an overlapping direction, the first wire faces the third wire, and the second wire faces the third wire, wherein the print head includes one or a plurality of drive element groups each including a plurality of drive elements which are driven to print a same type of color, wherein the first cable and the second cable each include a plurality of the first wires which propagate the first drive signals and a plurality of the second wires which propagate the second drive signals, to each of the drive element groups which prints the same type of color, and wherein, of the plurality of first wires in the first cable, the first wire which is positioned at an endmost portion in a wire arrangement direction and, of the plurality of first wires in the second cable, the first wire which is positioned next to the third wire which is positioned at an endmost portion in the wire arrangement direction are electrically connected in the print head, or of the plurality of second wires in the first cable, the second wire which is positioned next to the third wire which is positioned at an endmost portion in the wire arrangement direction and, of the plurality of second wires in the second cable, the second wire which is positioned at an endmost portion in the wire arrangement direction are electrically connected to each other in the print head.

* * * * *